US011262147B2

(12) United States Patent
Quaintance et al.

(10) Patent No.: US 11,262,147 B2
(45) Date of Patent: Mar. 1, 2022

(54) FIREARM SAFETY DEVICE

(71) Applicant: AmmoBlock LLC, Whitefish Bay, WI (US)

(72) Inventors: Charles William Quaintance, Whitefish Bay, WI (US); Peter David Quaintance, Whitefish Bay, WI (US); Kyle Mitchell Kaplan, Morton Grove, IL (US)

(73) Assignee: AmmoBlock LLC, Whitefish Bay, WI (US)

( * ) Notice: Subject to any disclaimer, the term of this patent is extended or adjusted under 35 U.S.C. 154(b) by 0 days.

(21) Appl. No.: 16/999,396

(22) Filed: Aug. 21, 2020

(65) Prior Publication Data

US 2021/0055070 A1 Feb. 25, 2021

Related U.S. Application Data

(60) Provisional application No. 62/891,034, filed on Aug. 23, 2019.

(51) Int. Cl.
*F41A 17/44* (2006.01)
*F41A 17/02* (2006.01)

(52) U.S. Cl.
CPC ..... *F41A 17/44* (2013.01); *F41A 17/02* (2013.01)

(58) Field of Classification Search
CPC ..... F41A 17/02; F41A 17/44
See application file for complete search history.

(56) References Cited

U.S. PATENT DOCUMENTS 2,530,560 A * 11/1950 Young ..... F41A 17/44 42/70.01
2,836,918 A 6/1958 Pula et al.
(Continued)

FOREIGN PATENT DOCUMENTS

AU 2014334818 4/2015
CA 2385279 11/2003
(Continued)

OTHER PUBLICATIONS

"How Shotguns Work: Break, Bolt and Pump Actions", https://science.howstuffworks.com/shotgun5.htm.
(Continued)

*Primary Examiner* — Gabriel J. Klein
(74) *Attorney, Agent, or Firm* — Jansson Munger McKinley & Kirby Ltd.

(57) ABSTRACT

A firearm safety device purposed to obstruct the chamber of a firearm to block insertion of a cartridge therein, effectively disabling the firearm. In embodiments, the firearm safety device comprises a plug and a key. The plug may be sized for fitting within the chamber of essentially any firearm. The plug may be inserted into and removed from the firearm through the breech end of the chamber, thereby lessening both wear on the plug and potential damage to the firearm resulting from plug insertion or removal. The key interacts with the plug for easy positioning of the plug within the chamber and pulling removal of the plug out from the breech end of the chamber. Unauthorized removal of the plug is difficult without the key. The safety device enables repeated cycling of the action and dry firing of the firearm enabling the firearm to be handled safely for uses such as for retail sale purposes and for firearm use and safety training.

28 Claims, 17 Drawing Sheets

(56) References Cited

U.S. PATENT DOCUMENTS

| | | | | |
|---|---|---|---|---|
| 3,089,272 | A | 5/1963 | McKinlay | |
| 3,154,874 | A * | 11/1964 | Stewart | F41A 17/44 42/70.11 |
| 3,156,373 | A | 11/1964 | Willis | |
| 3,193,959 | A | 7/1965 | Jaycox | |
| 3,378,943 | A | 4/1968 | Valburg | |
| 3,444,639 | A | 5/1969 | Rockwood | |
| 3,678,609 | A | 7/1972 | Fazio | |
| 3,708,901 | A | 1/1973 | Wolter | |
| 3,710,490 | A | 1/1973 | Cornett et al. | |
| 3,848,350 | A | 11/1974 | Seminiano | |
| 4,136,476 | A | 1/1979 | Hetrick | |
| 4,266,356 | A | 5/1981 | Jarvinen | |
| 4,776,123 | A | 10/1988 | Ascroft | |
| 4,827,649 | A * | 5/1989 | Sheehan | F41A 17/02 42/70.11 |
| 4,835,894 | A | 6/1989 | Libassi | |
| 4,908,971 | A | 3/1990 | Chaney | |
| 4,965,952 | A | 10/1990 | Miller et al. | |
| 5,048,211 | A | 9/1991 | Hepp | |
| 5,062,233 | A | 11/1991 | Brown | |
| 5,070,635 | A | 12/1991 | Cvetanovich | |
| 5,097,613 | A | 3/1992 | Miller et al. | |
| 5,115,589 | A * | 5/1992 | Shuker | F41A 17/44 42/70.11 |
| 5,179,234 | A | 1/1993 | Cvetanovich | |
| 5,315,778 | A * | 5/1994 | Wolford | F41A 17/44 102/511 |
| 5,357,704 | A | 10/1994 | Benkovic | |
| 5,410,832 | A | 5/1995 | Barnhart | |
| 5,435,090 | A * | 7/1995 | Darrow | F41A 17/44 42/70.11 |
| 5,446,988 | A | 9/1995 | Frederick, Jr. | |
| 5,450,685 | A | 9/1995 | Peterson | |
| 5,664,358 | A | 9/1997 | Haber et al. | |
| 5,950,344 | A * | 9/1999 | Ross | F41A 17/44 42/70.11 |
| 6,212,813 | B1 | 4/2001 | Luna et al. | |
| 6,237,272 | B1 | 5/2001 | Scott | |
| 6,250,008 | B1 | 6/2001 | Silver | |
| 6,393,750 | B1 | 5/2002 | Rossini et al. | |
| 6,470,615 | B1 * | 10/2002 | Peterken | F41A 17/44 42/70.01 |
| 6,502,344 | B1 * | 1/2003 | Zeh | F41A 17/44 42/70.01 |
| 6,526,684 | B1 | 3/2003 | Hickerson | |
| 6,578,308 | B2 | 6/2003 | Hickerson | |
| D482,424 | S | 11/2003 | Barber et al. | |
| 6,796,072 | B2 | 9/2004 | Barber et al. | |
| 6,862,831 | B1 | 3/2005 | Canaday | |
| 6,871,438 | B2 | 3/2005 | Lawless | |
| 7,043,949 | B2 | 5/2006 | Ross et al. | |
| 7,140,139 | B2 | 11/2006 | Markbreit et al. | |
| 7,146,761 | B2 | 12/2006 | Milo | |
| 7,150,122 | B1 | 12/2006 | Ha | |
| 7,832,136 | B2 | 11/2010 | Rush | |
| 8,474,171 | B1 | 7/2013 | Simmons | |
| 8,555,540 | B2 | 10/2013 | Woodford | |
| D701,282 | S | 3/2014 | Ferguson, II et al. | |
| 8,857,092 | B2 | 10/2014 | Bitsack | |
| 8,881,443 | B2 | 11/2014 | Westwood et al. | |
| 8,943,866 | B2 | 2/2015 | Fernandez et al. | |
| 8,959,819 | B2 | 2/2015 | Jones et al. | |
| 8,979,537 | B2 | 3/2015 | Stone | |
| 9,010,007 | B2 | 4/2015 | Chandler et al. | |
| 9,310,149 | B2 | 4/2016 | Masters | |
| 9,803,944 | B2 | 10/2017 | Pittman et al. | |
| 9,810,499 | B1 | 11/2017 | Silver | |
| 9,927,196 | B2 | 3/2018 | Bitsack | |
| 9,939,220 | B2 | 4/2018 | Speller | |
| 9,939,226 | B2 | 4/2018 | Seymore et al. | |
| 10,048,032 | B1 | 8/2018 | Lazar | |
| 2002/0170222 | A1 * | 11/2002 | Alanko | F41A 17/44 42/70.11 |
| 2002/0170223 | A1 * | 11/2002 | Beretta | F41A 17/44 42/70.11 |
| 2002/0189148 | A1 | 12/2002 | Hanson | |
| 2003/0172572 | A1 | 9/2003 | Clark | |
| 2003/0221351 | A1 | 12/2003 | Barber et al. | |
| 2004/0011100 | A1 * | 1/2004 | Ross | E05B 19/00 70/408 |
| 2004/0055199 | A1 | 3/2004 | Chudwin | |
| 2004/0200113 | A1 | 10/2004 | Lawless | |
| 2006/0288625 | A1 | 12/2006 | Williams | |
| 2009/0071054 | A1 | 3/2009 | Rush | |
| 2011/0173860 | A1 | 7/2011 | Arendt | |
| 2015/0089856 | A1 | 4/2015 | Stone | |
| 2015/0135571 | A1 | 5/2015 | Kohel, Sr. | |
| 2015/0168090 | A1 | 6/2015 | Bitsack | |
| 2016/0076843 | A1 | 3/2016 | Masters | |
| 2016/0245610 | A1 | 8/2016 | Schultz | |
| 2017/0138687 | A1 | 5/2017 | Aziz et al. | |
| 2017/0241730 | A1 | 6/2017 | Ochoa | |
| 2019/0011206 | A1 | 1/2019 | Campagna et al. | |

FOREIGN PATENT DOCUMENTS

| | | |
|---|---|---|
| CA | 2493412 | 10/2007 |
| CA | 2769865 | 4/2016 |
| CN | 109297352 | 2/2019 |
| CN | 208505101 | 2/2019 |
| DE | 102011108542 | 1/2013 |
| DE | 102010000644 | 5/2014 |
| EP | 600789 | 11/1993 |
| EP | 2 498 041 | 3/2012 |
| ES | 2044417 | 6/1991 |
| ES | 2363495 | 1/2003 |
| ES | 2 389 691 | 3/2009 |
| ES | 2584242 | 4/2016 |
| FR | 2938325 | 5/2010 |
| FR | 3047303 | 8/2017 |
| WO | 2006052440 | 5/2006 |
| WO | 2019020996 | 1/2019 |

OTHER PUBLICATIONS

"gunBlocker, www.gunblocker.com>. Date: downloaded from the Internet May 14, 2019.".

"Barrelblok, < https://bloksafety.com/>, Date: downloaded from the Internet May 14, 2019.".

"Trainsafe, <https://trainsafe.us/>, Date: downloaded from the Internet May 6, 2021.".

"Omega, <http://www.omegagunlock.com/>, Date: downloaded from the Internet May 13, 2019.".

* cited by examiner

FIREARM SAFETY DEVICE

RELATED APPLICATION

This application claims the benefit of U.S. Provisional Patent Application Ser. No. 62/891,034 filed Aug. 23, 2019. The entire content of Patent Application Ser. No. 62/891,034 is incorporated herein by reference for continuity of disclosure.

FIELD

The field relates to firearm safety devices and, more particularly, to plug-type devices for obstructing the insertion of a cartridge into a chamber of the firearm.

BACKGROUND

For certain uses of firearms, there is a need to both disable the firearm so that it is incapable of discharging a projectile and yet also permit the repeated cycling of the firearm's action so that the firearm can be dry fired. In other words, there is a need in certain settings for the firearm, and the action of the firearm in particular, to freely operate while the firearm is in a "safe" state wherein actual discharge of the weapon would be impossible or very difficult. Examples of the foregoing types of uses include firearm marketing and sales settings, firearm training for military and law enforcement personnel, firearm safety education for civilians, and general firearm safety purposes.

Various efforts have been made to provide firearm safety devices, but such devices have certain disadvantages rendering them unsuitable for accomplishing the aforementioned objectives.

For example, plug-type devices are described in U.S. Pat. Nos. 3,678,609 (Fazio), 3,444,639 (Rockwood), 4,776,123 (Ascroft), 5,070,635 (Cvetanovich), 5,179,234 (Cvetanovich), 6,237,272 (Scott), and 9,310,149 (Masters). All of these plug-type devices are intended for insertion into the chamber of the firearm to prevent chambering of a cartridge. The plugs are held in place in the chamber by means of a friction fit. The devices described in these patents are disadvantageous at least because the plugs must be removed by knocking them out of the chamber by means of a cleaning rod or special tool inserted through the muzzle end of the barrel. Such removal process is disadvantageous at least because the rod or tool required for use with a rifle or shotgun is long and unwieldy, which is undesirable if there is a need to quickly remove the plug for self-defense or some other purpose. Further, any contact between the cleaning rod or tool and the inside or outside surfaces of the barrel can damage the barrel, potentially diminishing the value of the firearm. The O-ring or other friction surface can become damaged and lose effectiveness by repeated insertion and removal of the plug from the chamber, especially if the O-ring must be inserted through or removed from the muzzle end of the firearm because of the relatively increased contact between the barrel and the O-ring during plug insertion and removal.

Other plug-type devices require expandable plug bodies or expandable O-rings as a means to secure the plug within the chamber. Examples are described in U.S. Pat. Nos. 5,315,778 (Wolford), 5,450,685 (Peterson), 5,950,344 (Ross) and 7,043,949 (Ross) These types of plugs are disadvantageous at least because they require complex and relatively costly internal moving parts, such as compression screws, which act on and expand the plug body or O-ring. in some (i.e., the Ross '344 and '949 patents), the fit of the plug within the chamber can be so tight that the action cannot be cycled more than once until the plug has been removed, rendering the firearm unsuitable for the above-mentioned purposes. A special tool is required to tighten and loosen the moving components of such a plug and operation of the tool is through the muzzle end of the barrel which is unwieldy and inconvenient, especially if used with a long-barreled rifle or shotgun. As with the previous group of plugs, any contact between the tightening/loosening tool and the inside or outside surfaces of the barrel can damage and diminish the value of the firearm.

The safety device of U.S. Pat. No. 7,140,139 (Markbreit) requires a key-operated locking mechanism, Utilization of a locking mechanism requiring a custom key to actuate key pins which adds cost and complexity to the device.

Still other types of safety devices, such as in U.S. Pat. No. 9,939,220 (Speller) and U.S. Publication No. 2004/0200113 (Lawless), can be easily removed simply by pushing or gripping the device with a person's hand. A plug-type device which is easily removed by means of a user's hand may not provide adequate safety.

It would be an advance in the art to provide improved firearm safety devices which would render a firearm inoperable and/or limit unwanted discharge of a projectile, which would enable repeated operation of the action of the firearm so that the firearm can be dry fired during each operational cycle, which would avoid excessive wear and potential damage to the firearm, which would facilitate safe marketing and sale of the firearm, which would facilitate firearm training and safety education, which would be simple and easy to use, and which would generally have improved performance relative to existing safety devices.

SUMMARY

Embodiments of a firearm safety device are described and illustrated herein. The firearm safety device is purposed to obstruct the chamber of a firearm to block insertion of a cartridge therein thereby avoiding or limiting unwanted discharge of the firearm. The design of the safety device enables repeated cycling of the action and dry firing of the firearm, permitting the firearm to be handled more safely for uses such as for retail sale purposes and for firearm use and safety training and education, as well as for general safety purposes.

In embodiments, a firearm safety device may comprise a plug and a key. The body of the plug may be rigid, fixed, or static and generally cylindrical and may be sized and shaped for insertion into the chamber of the firearm through the breech end of the chamber. A forward end of the body is inserted into the chamber through the breech end, while a rearward end of the body is toward the firing pin of the firearm. The body may include a rim to limit movement of the plug into the chamber and the rim may include structure which avoids ejection of the plug by the extractor claw of the firearm. In embodiments, the plug may include a compressible element, such as an O-ring, which extends out past the body to exert a force sufficient to snugly retain the body in the chamber against gravity.

The body of the plug preferably includes a keyway. The keyway may extend axially into the body from the rearward end of the plug and into the body. A first catch may be within the keyway spaced in from the rearward end. The first catch may be at a position within the body inaccessible to a human finger, thereby making unauthorized removal of the plug difficult. In embodiments, the plug may comprise first and second rigid, fixed, or static body portions. Such body portions may collectively form the body, keyway, and the first catch.

The key, also referred to herein as a "puller key", may be provided as part of the combination for ease of insertion of the plug through the breech end of the chamber, for positioning of the plug within the chamber, and for pulling of the plug from the chamber when removal is desired. In embodiments, the key may have a handle and a second catch toward an end of the handle. The second catch may be sized to fit into the keyway within the body to engage the first catch within the keyway. Such engagement of the first catch with the second catch enables the pulling of the plug out of the breech end of the chamber.

Other aspects, examples, and advantages of the firearm safety device and invention are described in the disclosure which follows.

BRIEF DESCRIPTION OF DRAWINGS

Exemplary firearm safety devices may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

Figure 28:
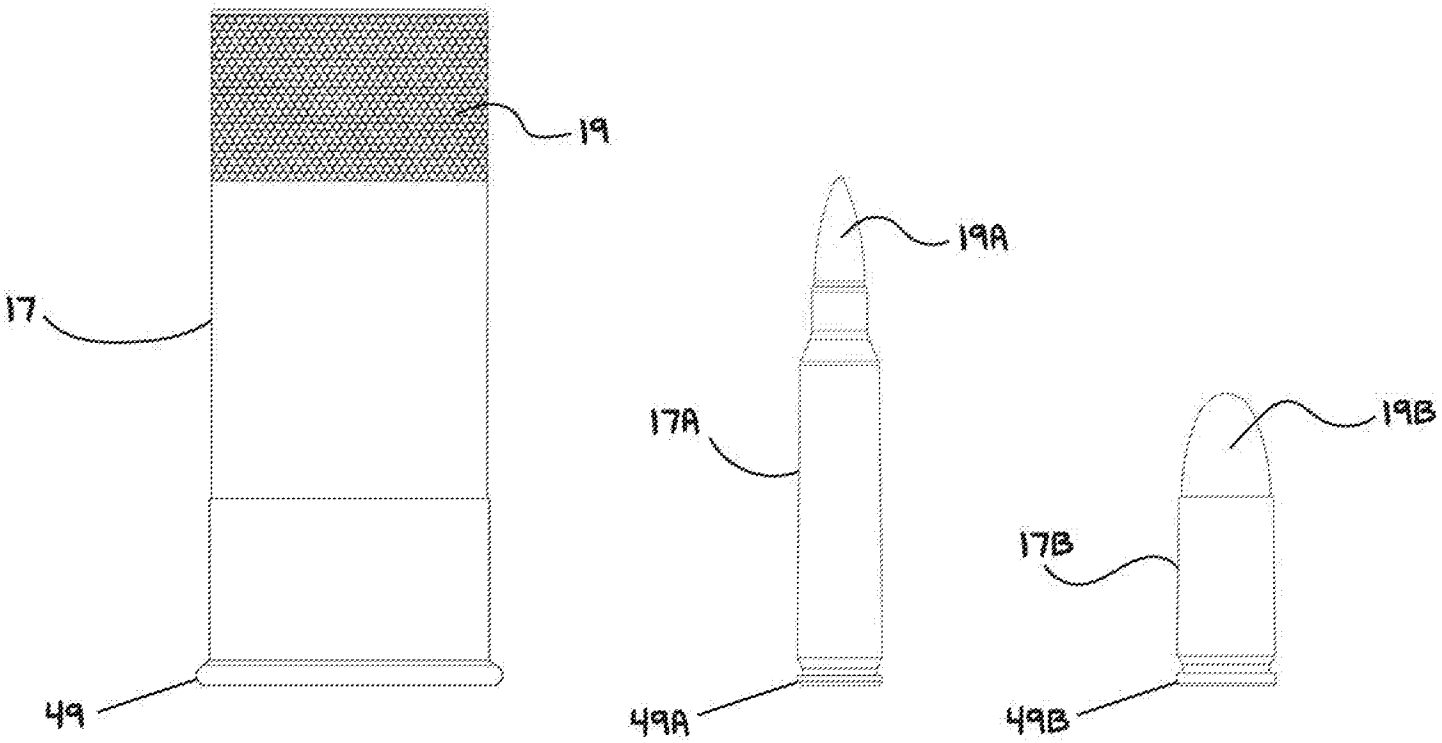
FIG. 28 shows examples of cartridges to illustrate that a safety device according to the invention may be sized and adapted for use with firearms of different types and calibers.

Referring now to FIGS. 1-23, there is shown an embodiment of an exemplary firearm safety device 10. In the embodiments, firearm safety device 10 comprises a plug 11 in combination with a key 13, which may also be referred to herein as a "puller key". Plug 11 may be sized for use to disable essentially any type of firearm 15 such that the firearm 15 is incapable of chambering a cartridge 17, 17A, 17B, preventing discharge of a projectile or projectiles 19, 19*a*, 19*b* from the firearm (FIG. 28). As used herein, "chambering" means or refers to insertion of a cartridge 17 into chamber 21 of firearm 15. Chamber 21 may, of course, be defined in part by chamber wall 22, which may be fully or partially cylindrical. Referring to FIG. 28 and by way of example only, plug 11 may be sized to prevent chambering of a shotgun shell cartridge 17, or a .223 Rem rifle cartridge 17A, or a 9 mm pistol cartridge 17B, thereby preventing discharge of shot-type projectiles 19, or rifle or pistol bullet projectiles 19A, 19B from the appropriate firearm 15.

As illustrated in the examples of FIGS. 25A-27, plug 11 is purposed to fit within chamber 21 of a pump-action shotgun to obstruct the chamber 21 to prevent insertion of a shotgun shell cartridge 17, therein rendering the firearm 15 safe as long as plug 11 remains within chamber 21. Puller key 13 may be used to position plug 11 through breach 23 portion of chamber 21 and within chamber 21. Importantly, puller key 13 may also be used to pull plug 11 back out of the chamber 21, through the breech 23, when normal operation of the firearm 15 is desired.

An important aspect of safety device 10 is that while it obstructs chamber 21 to prevent chambering of a cartridge 17 therein, it also permits and does not interfere with repeated cycling of the action 27 of firearm 15 and dry firing of firearm 15 with plug 11 in place within chamber 21. Dry firing of firearm 15 means or refers to operating action 27, but without a cartridge 17 in chamber 21. This capability enables firearm 15 to be used safely for retail sales and marketing purposes, for military and law enforcement training purposes, for firearm safety education purposes, and for any other purpose where safe operation of action 27 and use of firearm 15 is desired.

By way of background and in order to facilitate understanding of the utility of safety device 10, it is useful to first describe operation of a firearm 15 with which an example of safety device 10 may be used. FIGS. 25A-27, illustrate a firearm 15 in the form of a pump-action shotgun, which is one type of firearm 15 with which safety device 10 may be used. it is to be understood that safety device 10 may be used with essentially any category of firearm 15, including with shotguns, rifles, and pistols, etc., and that the pump-action shotgun presented herein is merely an example.

Referring then to FIGS. 25A-27, certain well-known parts of a typical pump-action shotgun are illustrated therein. The exemplary pump-action shotgun includes a receiver 25 which houses certain components of action 27, stock 29, trigger guard 31, trigger 33, magazine 35, fore-end 37, barrel 39, and muzzle 41. Action 27 means or refers to the operating mechanism of firearm 15.

A simplified description of the operation of a pump-action shotgun is provided by the website How Stuff Works. https://science.howstuffworks.com/shotgun5.htm. To prepare for firing, the operator slides fore-end 37 rearward and then forward. This racking motion operates action 27. The rearward motion of fore-end 37 depresses the hammer (not shown) of action 27 and loads a shell-type cartridge 17 in chamber 21. A spring-loaded sear component of action 27 (not shown) holds the hammer in the firing position.

Of course, once a shell-type cartridge 17 is loaded into the shotgun-type firearm 15 and the hammer is in a firing position, there is a risk of unwanted discharge or firing of the firearm 15. As will be described in detail below, plug 11 of safety device 10, when provided, obstructs chamber 21 preventing insertion of a shell-type cartridge 17 therein so that the pump-action shotgun firearm 15 cannot be discharged.

The firing process avoided through implementation of safety device 10 occurs by pulling trigger 33 which releases the sear from the hammer. The hammer strikes a spring-loaded firing pin (not shown) of the action 27 which impacts the primer (not shown) of the shell-type cartridge 17 in chamber 21, causing discharge of shot-type projectiles 19. As the operator releases trigger 33, the tension on the sear is relaxed.

The operator then pulls fore-end 37 rearward to eject shell 17 and to reload by means of the action 27 as will now be described. As slide 43 of action 27 connects with breech bolt 45, the locking block (not shown) moves out of the firing position and retracts the firing pin.

Figure 26:
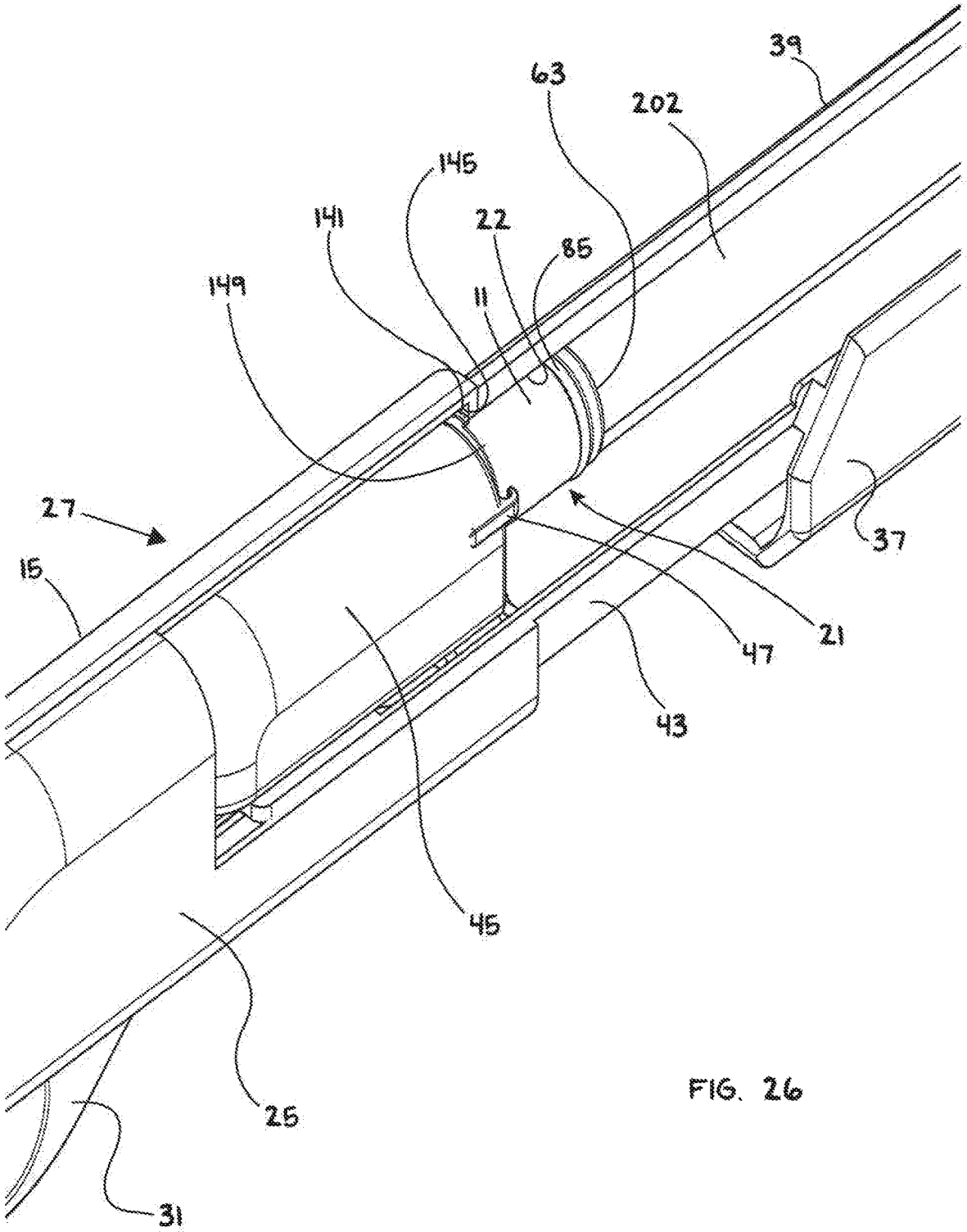
FIGS. 26-27 are cut-away views showing elements of an action of the shotgun of FIGS. 25A-25J and the firearm safety device of FIGS. 1-8 positioned in the shotgun.
Figure 27:
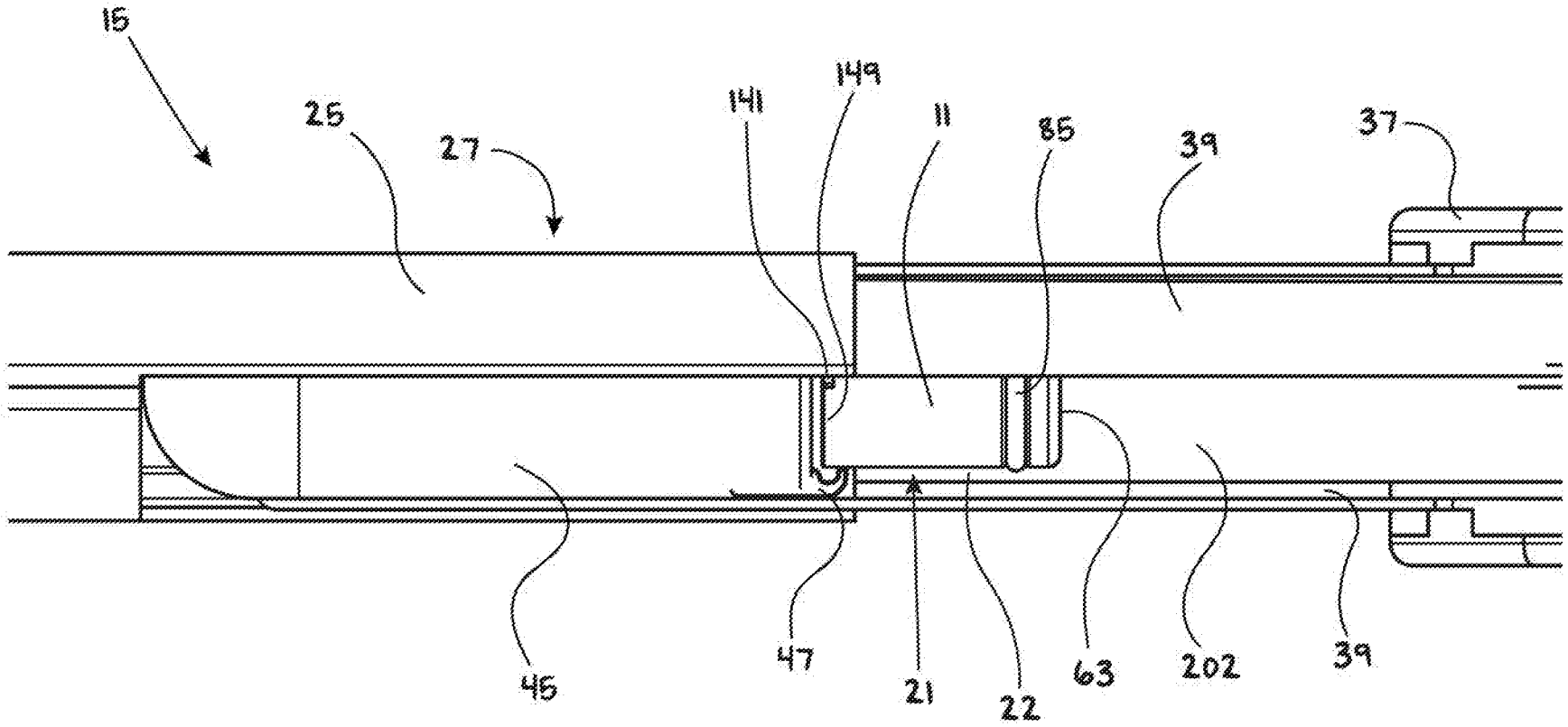

FIGS. 26-27 illustrate an extractor 47 of action 27. Extractor 47 may be carried on the breech bolt 45 to contact and grip a rim 49 of the spent shell-type cartridge 17 (or a rim 49*a*, 49*b* of a respective cartridge 17A, 17B). One extractor 47 is shown in FIGS. 26-27, but plural extractors are commonplace in firearms. When breech bolt 45 moves, it pulls the spent shell-type cartridge 17 along with it because of the contact between the extractor 47 and rim 49 shell-type cartridge 17. The motion of the operator pulling fore-end 37 back, pushes slide 43 and breech bolt 45 to the rear of the receiver 25. The extractor 47 pulls the spent shell-type cartridge 17 into the opening of ejection port 51 of receiver 25. At the same time, the magazine spring (not shown) pushes a new shell-type cartridge 17 onto the carrier (not shown). As breech bolt 45 is pushed back, extractor 47 pulls the spent shell-type cartridge 17 into the path of a spring (not shown) that forces it out of ejection port 51.

As will be described below and as is illustrated in FIGS. 26-27, plug 11 embodiments may be provided with structure that prevents contact between extractor 47 and plug 11, thereby retaining plug 11 in chamber 21 and preventing plug 11 from being ejected as would be the spent shell-type cartridge 17. With plug 11 unable to be ejected, the pump-action shotgun action 27 can be repeatedly cycled and the firearm 15 dry fired without risk of accidental discharge because a new shell-type cartridge 17 cannot be transferred from the carrier to chamber 21 should such a cartridge 17 reside in magazine 35.

Referring next to FIGS. 1-23, exemplary safety device 10 capable of temporarily preventing discharge of a firearm 15, such as the aforementioned pump-action shotgun, will next be described. An example of a plug 11 will first be described followed by a description of puller key 13. In the examples, plug 11 may comprise a first body portion 53 and a second body portion 55. First and second body portions 53, 55 may be interconnected such that portions of first body portion 53 fit within second body portion 55 as described and illustrated herein to desirably provide certain internal components not necessarily capable of manufacture from a single blank of material.

In the examples, first and second body portions 53, 55 may be of one or more rigid material and may be characterized as "rigid body portions". Body portions 53, 55 may also be described as fixed or static. Implementation of rigid, fixed, or static materials for use in manufacture of body portions 53, 55 has the advantage of simplicity and ease of sizing to the diameter of a given firearm 15 chamber 21. Body portions 53, 55 of the examples are of a "fixed" or "static" type in the sense that they do not include internal moving parts, such as expandable body portions or mechanical expansion screws which expand or contract expandable body portions. Opportunities for cost reduction are made possible by utilization of non-moving parts in certain examples.

Referring then to the examples of FIGS. 1-13, first body portion 53 may include a base portion 57 purposed to provide a support base for shaft 59 and first catch 61. In the examples, base 57 may be deemed a forward or leading end of plug 11, which is forward or leading in the sense that it is the end of plug 11 first inserted into breech 23 when plug 11 is inserted into chamber 21. Base 57 may be cylindrically-shaped between forward 63 and rearward 65 end surfaces and may define an axis 67, Outer edge surface 69 may provide a circumferential edge surface which may have a uniform outside diameter 71 about axis 67 between forward and rearward end surfaces 63, 65. Base 57 bounded by outer edge surface 69 may have an outside diameter 71 sized to match or approximate the caliber of the firearm chamber 21 for which plug 11 is intended.

In the examples, first body portion 53 may include a spacer 73. Spacer 73 may be integral with (i.e., a part of) base 57. Spacer 73 may provide the appearance of a stepped surface of base 57 rearward end surface 65. Spacer 73 may include a rearward surface 75, and an outer edge surface 77. Spacer 73 may be coaxial with axis 67 and outer edge surface 77 may be a circumferential edge surface with a common but lesser diameter 79 about axis 67 than outside diameter 71 of outer edge surface 69, thereby providing the stepped appearance. Spacer 73 may be, but is not required to be, coaxial with axis 67 and outer edge surface 77 of spacer 73 may be a circumferential edge surface with a uniform diameter 79 about axis 67. Spacer 73 could be offset from axis 67 in certain embodiments. In other embodiments, spacer 73 may be a separate part, for example a disc-shaped part.

In embodiments, spacer 73 may have an axial dimension 81 sufficient to space base 57 from second body portion 55 to provide an annular groove 83, or gap, between base 57 of first body portion 53 and second body portion 55. Such spacing may be of a sufficient axial distance to enable plug 11 to include a compressible member 85 in annular groove 83, or gap, between base 57 and second body portion 55 to hold plug 11 in chamber 21 as described herein. Compressible member 85 may also be characterized as a portion or element of plug 11. In embodiments, compressible member 85 may be an O-ring made of a pliant material such as rubber. Compressible member 85 may be provided to exert a force against chamber wall 22 which snugly holds plug 11 in chamber 21 so that plug 11 is retained in chamber 21 against gravity.

Referring to FIGS. 6-13, first body portion 53 base 57 may support elongate shaft 59 and first catch 61. In the examples, base 57 and spacer 73 are integral and elongate shaft 59 extends out and away from rearward surface 75 of spacer 73 to a shaft distal end 87. Shaft 59 may include a proximal portion 88 adjacent spacer 73 an outer surface 89 and a rearward surface 91. Shaft 59 may further have a projection portion 93 outward from rearward surface 91 and projection 93 may have an outer surface 95.

Shaft 59 and projection 93 portion of shaft 59 may be, but are not required to be, coaxial with each other and with axis 67 and outer surfaces 89, 95 may each be a circumferential cylindrically-shaped outer surface 89, 95. Shaft 59 outer surface 89 at proximal portion 88 may have a common but lesser outside diameter 97 about axis 67 than respective outside diameters 71, 79 of the base 57 outer edge surface 69 and the spacer 73 outer edge surface 77 further providing a stepped appearance.

Also as in the examples, projection 93 circumferential cylindrically-shaped outer surface 95 may have an outside diameter 99 less than diameter 97 of proximal portion 88 of shaft 59. Shaft 59 may have an axial dimension 101 sized such that projection 93 and first catch 61 are within keyway 103 at a position within plug 11 inaccessible to a human finger, necessitating use of puller key 13 for removal of plug 11 from chamber 21 as explained herein.

In the examples, first catch 61 may be associated with shaft 59 projection 93 toward distal end 87 of shaft 59 and may comprise pins 105, 107 extending radially and coaxially outward from shaft 59 projection 93 generally normal (i.e., perpendicular) to axis 67, Pins 105, 107 and shaft 59 projection 93 may have a generally T-shaped configuration as illustrated in FIGS. 6-10. As will be described, forward-facing surfaces 105A, 107A of pins 105, 107 (i.e., surfaces facing away from rearward end 113 of casing 109) may provide contact points for pulling by puller key 13 to pull plug 11 out from chamber 21. Rearward-facing surfaces 105D, 107D may provide contact points for pushing by puller key 13 to locate plug 11 within chamber 21, and side surfaces 105C, 107D and 105D, 107C may provide contact points for twisting contact by puller key 13 for rotating plug 11 within chamber 21 as described herein.

While a pair of pins 105, 107 are illustrated, any number of pins may be implemented to make a connection with puller key 13. Further, pins 105, 107 are not required to be coaxial. Surfaces 105A-105D and 107A-107D are not required to be planar, or flat. For example, pins 105, 107 may each have a cylindrical surface. In embodiments, mechanical first catch 61 structure other than pins 105, 107 may be implemented to provide a pulling connection with puller key 13. Other examples of catch-type mechanical structure suitable for use as first catch 61 could include detents, snaps, and threads.

While first body portion 53 is illustrated as a single integrated part, other embodiments are possible. For example, shaft 59 could be a part separate from base 57 and could be fixedly secured to base 57 by means such as a threaded coupling or adhesive.

In embodiments, first catch 61 may be of a single or "universal" design, size, and structure so that first catch 61 may be identical for each plug 11 that is sized for a different caliber or chamber 21 size. Such "universal" design of first catch 61 enables a single "universal" key 13 to be used with many different plugs 11 of different calibers and sizes.

Referring now to FIGS. 1-8 and 14-18, an example of second body portion 55 will next be described. In the embodiments, first and second body portions 53, 55 may be connected together to form components of plug 11 as illustrated, for example, in FIG. 8 and as described herein.

Second body portion 55 may include a cylindrically-shaped casing 109 which may be rearward of base portion 57 and which provides part of an outer portion or housing for plug 11 and an enclosure or casing for shaft 59 and first catch 61 as described herein. Casing 109 may have a forward end 111 and a rearward end 113 with an outer surface 115 therebetween coaxial with axis 67 and having an outside diameter 117 approximately the same as outside diameter 71 of base 57 of first body portion 53. Rearward end 113 of casing provides rearward end of plug 11 in the examples. In the examples of FIGS. 1-8, first and second body portions 53, 55 provide for a generally cylindrical plug 11 when interconnected. Plug 11 and first and second body portions 53, 55 can be scaled and sized to fit within essentially any chamber 21 of a firearm 15 and can be utilized with virtually any firearm 15 such as a shotgun (FIGS. 25A-27), rifle, or a pistol.

Casing 109 of second body portion 55 may be hollow and may include a cylindrical inner wall 119 and forward end edge 121 and rearward end edge 123 which may both be circular. In the examples, inner wall 119 and the forward and rearward end edge surfaces 121, 123 define a shaft-receiving space 125 and the keyway 103.

In the examples, inner wall 119 defines a generally cylindrical space 125 corresponding to the cylindrical outer surface 89 profile of proximal portion 88 of shaft 59. Inner wall 119 may define an inside diameter 127 which is slightly greater than outside diameter 97 of shaft 59 proximal portion 88 such that shaft 59 fits through rearward end edge 123 and snugly within shaft-receiving space 125. A tubular keyway 103 exists bounded by rearward end 113 of casing, rearward end edge 123, inner wall 119, and rearward surface 91 of shaft 59 when first and second body portions 53, 55 are connected together.

In the examples, rearward end edge 123 defining the start of keyway 103 may have an inside diameter 129 less than inside diameter 127 defined by inner wall 119. Inside diameter 129 may be sufficiently small that a human finger is blocked from insertion into keyway 103 by rearward end 113 of casing 109 (i.e., second body portion 55) and yet key 13 may be inserted through and into keyway 103. By way of example only, an inside diameter 129 of the keyway 103 opening defined by rearward end edge 123 of about 0.25 inch is a useful inside diameter 129 usable across a range of different cartridges such as cartridges 17, 17A, 17B. Such sizing advantageously restricts or prevents tampering removal of plug 11 from chamber 21 as described herein.

When shaft 59 is inserted within shaft-receiving space 125, spacer 73 rearward surface 75 abuts forward end 111 of casing 109 of second portion 55 of plug 11. An adhesive (not shown) may be applied between shaft 59 and inner wall 119 and between abutting spacer 73 rearward surface 75 and second body portion 55 forward end 111 to permanently and fixedly interconnect and join together first and second body portions 53, 55 into a single fixed, non-moving assembly.

An advantage of the foregoing structure of first and second body portions 53, 55 is that first and second body portions 53, 55 may be interconnected with first catch 61 of first body portion 53 within second body portion 55 and keyway 103 such that first catch 61 is spaced in from rearward end 113 of casing 109 of second body portion 55 and shielded from contact and pulling by a human finger.

Manufacture of such a complex part would be difficult and/or unnecessarily costly by means of a single injection molding process or through manufacture from a single blank of material, such as by machining.

Figure 19:
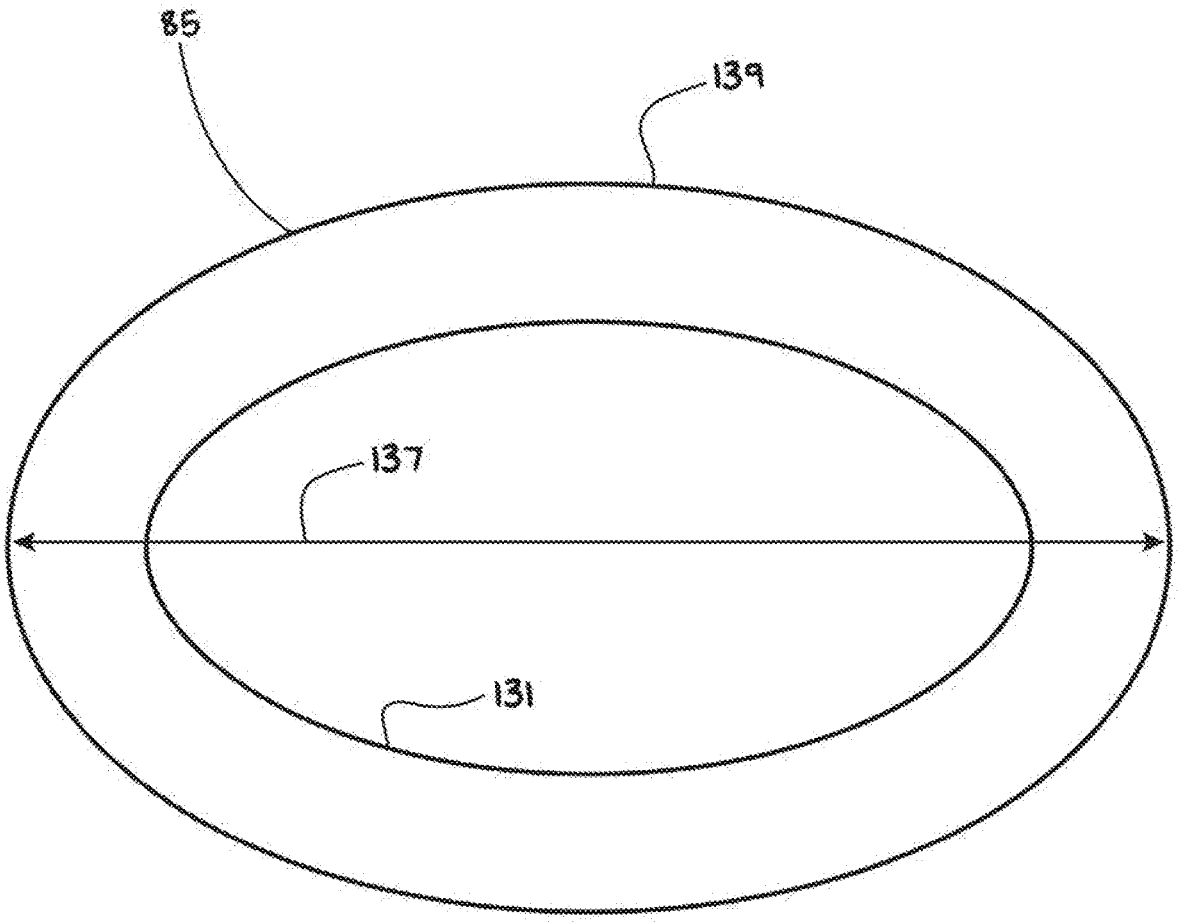
FIG. 19 is a perspective view of a compressible member suitable for use with the safety device of FIGS. 1-8.
Figure 20:
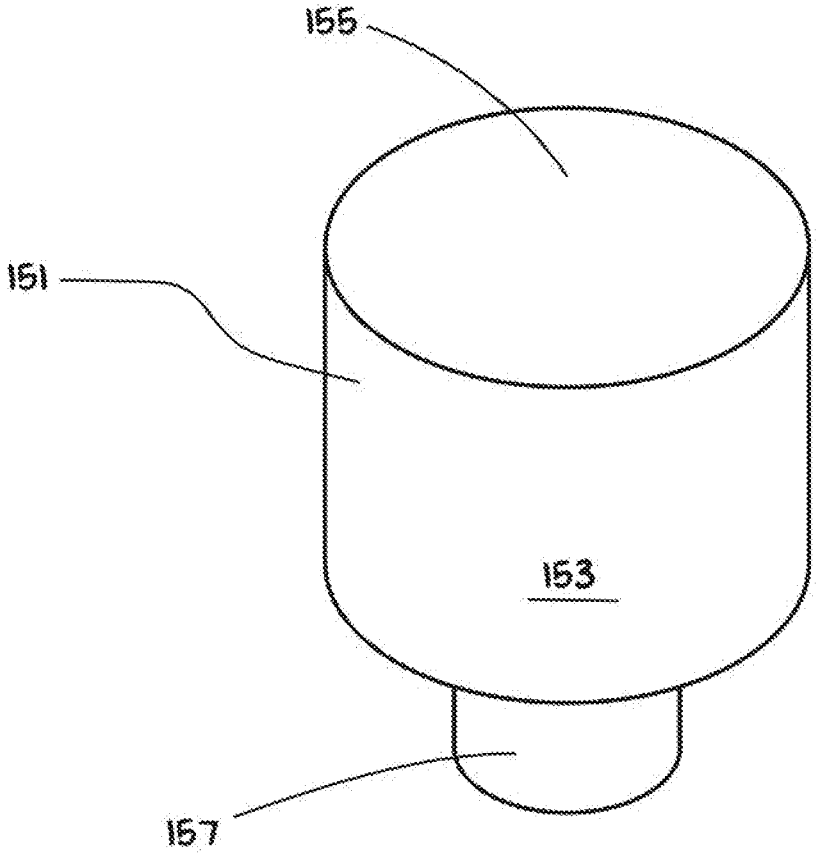
FIG. 20 is a perspective view of a pliant firing pin contact member suitable for use with the safety device of FIGS. 1-8.
Figure 21:
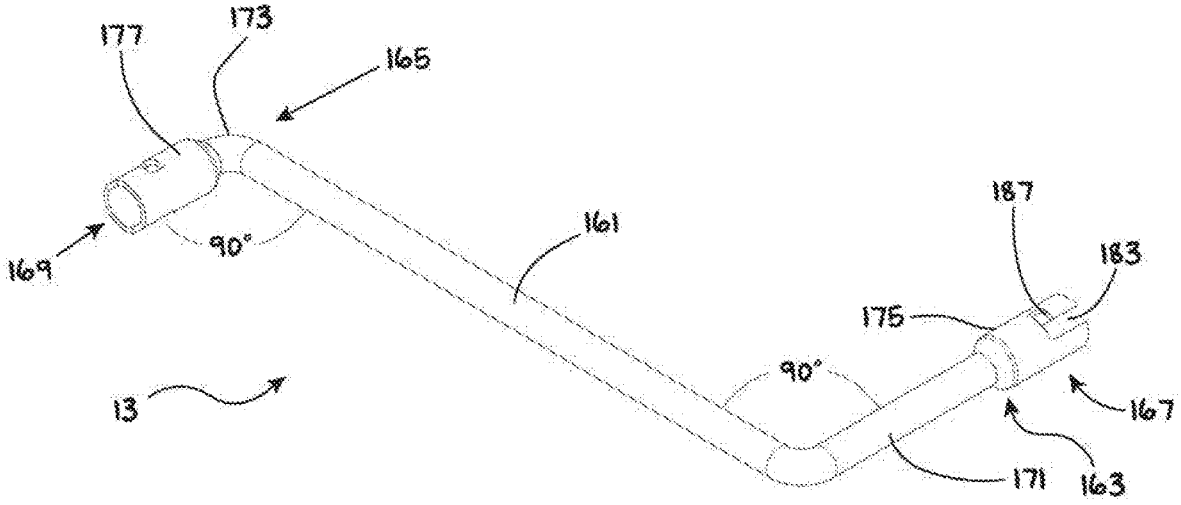
FIG. 21 is a perspective view of a key suitable for use with the safety device of FIGS. 1-8, illustrating two example of a second catch.
Figure 22:
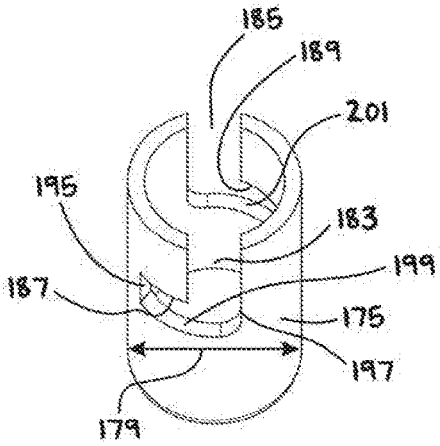
FIGS. 22-23 are perspective views of a second catch of the key of FIG. 21.
Figure 23:
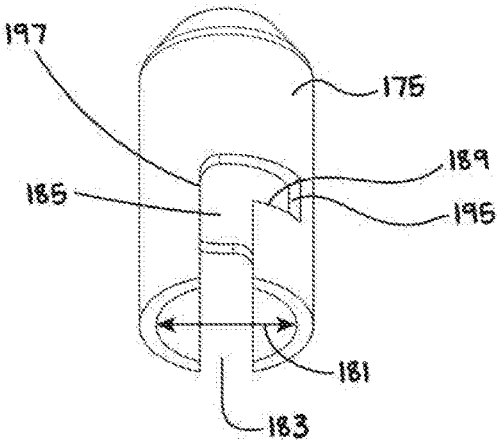

Referring now to FIGS. 1-3, 6-8 and 19, abutment of spacer 73 with second body portion 55 forms annular groove 83, or gap, between first and second body portions 53, 55, Compressible member 85 (i.e., a portion or element of plug 11), such as the O-ring shown in FIG. 19, may be fit within annular groove 83, or gap, such that an inner surface 131 of compressible member 85 abuts outer edge 77 of spacer 73 and forward and rearward surfaces 133, 135 of compressible member 85 abut rearward end 65 of base 57 and forward end 111 of casing 109 in effect fitting compressible member 85 within annular groove 83, or gap. Compressible member 85 may be coaxial with axis 67 in the embodiments. In the examples, compressible member 85 may have an outside diameter 137 between outer surface 139 which is slightly greater than outside diameters 71, 117 of base 57 and casing 109 such that outer surface 139 of compressible member 85 protrudes slightly beyond outer surfaces 69, 115 of base 57 and casing 109 for frictional contact with chamber wall 22.

Outer surface 139 of compressible member 85 provides a frictional surface. Contact between outer surface 139 of compressible member 85 and chamber wall 22 applies a force which holds plug 11 in chamber 21. Such force should be sufficient to at least retain plug 11 within chamber 21 against gravity. Plug 11 should not fall out of chamber 21 when firearm 15 is pointed upward, shaken, or otherwise handled. An advantage of safety device 10 is that just a minimal force is sufficient to retain plug 11 within chamber 21 while still providing a barrier to chambering of a cartridge 17. By way of example only, the force may be in the range of about 7.5 ounce to about 11.5 ounce, although compressible member 85 may be sized to adjust the force as desired to retain plug 11 in chamber 21.

Referring to FIGS. 1-8 and 14-18, embodiments of plug 11 may include a rim 141 extending radially outward from rearward end 113 of casing 109 in a plane 143 defined by rearward end 113 of casing 109 which may be normal to axis 67. If provided, rim 141 may contact outer wall 145 of receiver 25 (FIGS. 25, 26A) to limit forward movement of plug 11 into chamber 21 of firearm 15. Rim 141 may define one or more notch, such as the pair of radially-outward notches 147, 149 illustrated. Two notches 147, 149 are desirable for firearms 15 with two extractors (e.g., two of extractor 47). The purpose of notches 147, 149 is to provide contact avoidance between rim 141 and an extractor 47 of firearm 15. An extractor 47 extended within a notch 147, 149 is incapable of contacting rim 141 to eject plug 11. As described herein, plug 11 may be rotated within chamber 21 with puller key 13 to align notches 147, 149 with the extractors (e.g., extractor 47). Contact avoidance between extractor 47 and rim 141 enables repeated cycling of action 27 and dry firing of firearm 15 without ejection of plug 11. The capability to repeatedly cycle action 27 and to dry fire firearm 15 enables firearm 15 to be used for marketing, training, and educational purposes while being safely prevented from chambering a cartridge 17 while plug 11 is in chamber 21.

While a rim 141 with two notches 147, 149 is illustrated, it will be understood that other rim structure is acceptable. For example, a rim 141 with a single rim portion radially outward from rearward end 113 of casing 109 within plane 143 between, for example, 20 degrees around rearward surface 111, or a rim 141 with three notches, such as notches 147, 149, may be implemented.

A broad range of materials may be used to make first and second body portions 53, 55. Examples of materials for use in manufacture of body portions 53, 55 may include polyvinyl chloride, nylon 6/6, reinforced polymer, rubber, and other polymeric materials, Metals such as aluminum or zinc may be utilized. Combinations of materials may be implemented and body portions 53, 55 may be of materials which are different from the other.

Body portions 53, 55 may each be made respectively as a single, separate part by means of plastic injection molding processes which are efficient and cost-effective. Body portions 53, 55 may be made by any other suitable means such as by CNC machining, 3-D printing, selective laser sintering, and other types of rapid prototyping. Compressible member 85 may be an O-ring of a rubber material or the like.

Referring now to FIGS. 1, 4, 6-8, and 20, plug 11 may further include a firing pin contact member 151. In the examples, contact member 151 may be seated on distal end 87 of shaft 59 so as to be in the path of, and contacted by, the striking end of the firing pin (not shown) when plug 11 is in chamber 21 and firearm 15 is dry fired. Contact member 151 should be of a pliant (i.e., yielding) material to provide a type of cushion when contacted by the firing pin during operation of action 27 once trigger 33 is pulled and the sear (not shown) releases the hammer (not shown) to strike the firing pin (not shown) as described previously. Contact between the firing pin and the contact member 151 dissipates energy released once trigger 33 is pulled and action 27 operates to thereby avoid potential damage to components of action 27 which could be caused by dry firing of firearm 15.

Figure 1:
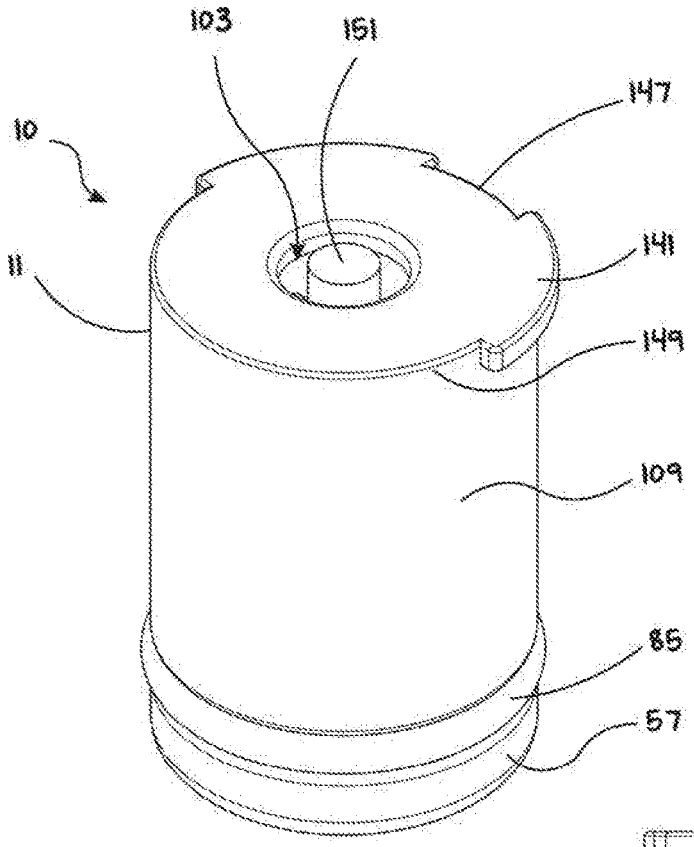
FIG. 1 is a perspective view of an embodiment of a firearm safety device in accordance with the invention.
Figure 2:
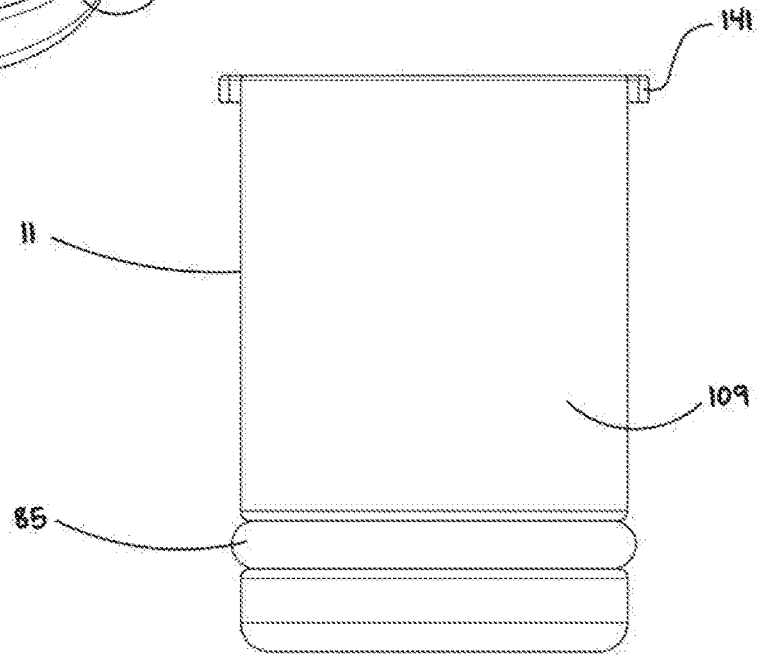
FIGS. 2-3 are side elevation views of the firearm safety device of FIG. 1.
Figure 3:
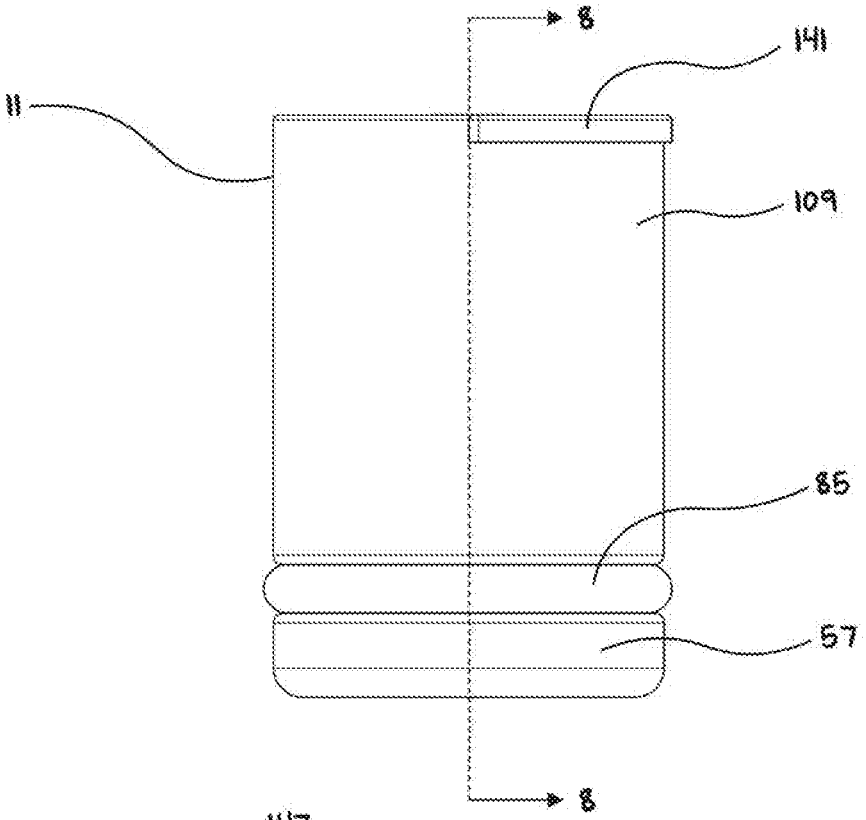
Figure 4:
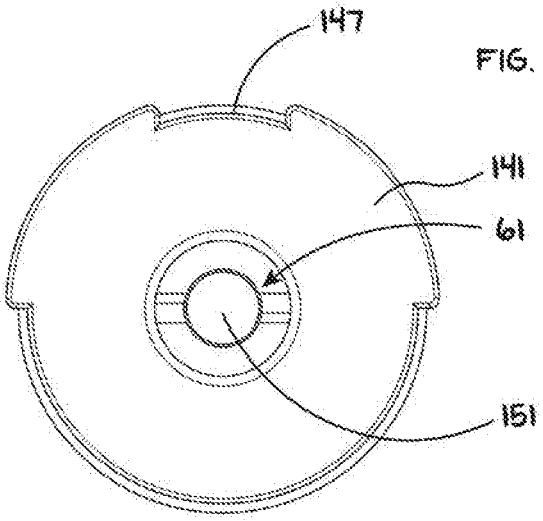
FIG. 4 is a rearward end view of the firearm safety device of FIGS. 1-3.
Figure 5:
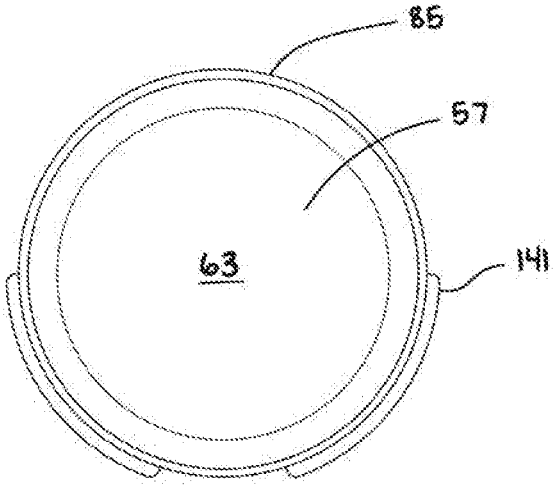
FIG. 5 is a forward end view of the firearm safety device of FIGS. 1-4.
Figure 6:
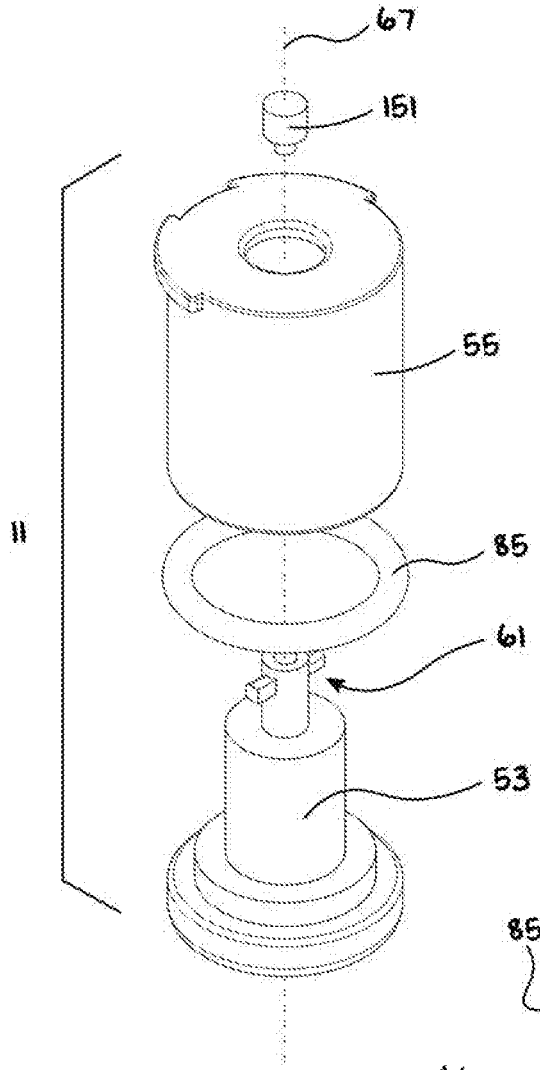
FIGS. 6-7 are exploded views of the firearm safety device of FIGS. 1-5.
Figure 7:
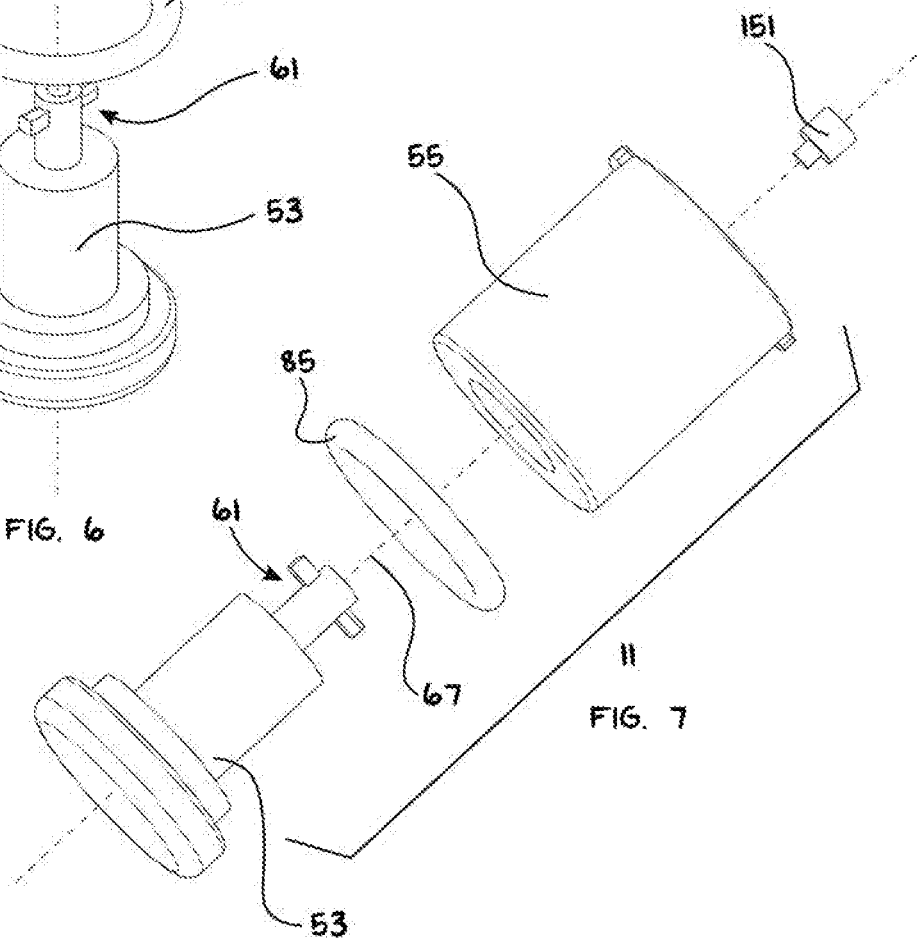
Figure 8:
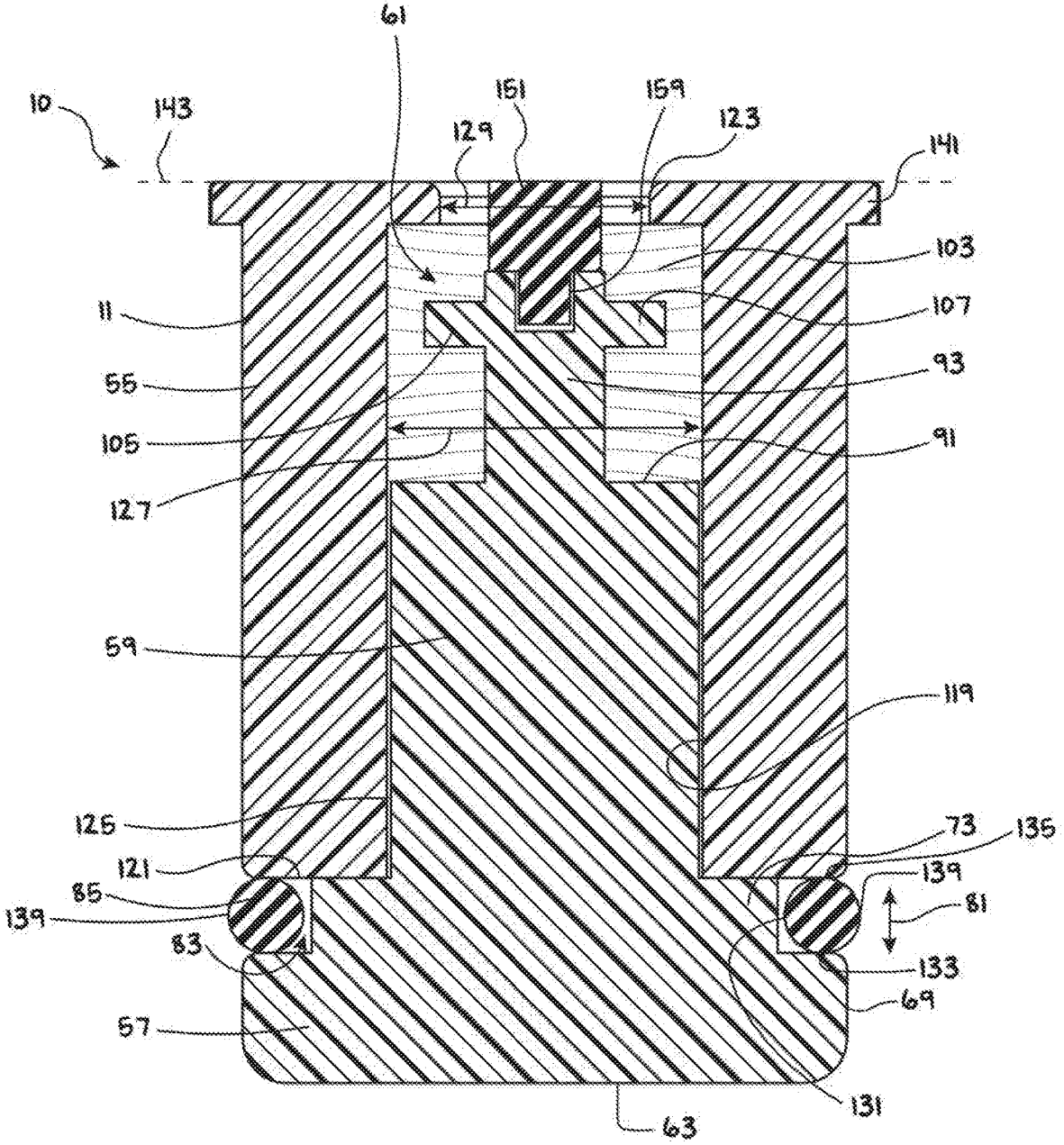
FIG. 8 is a sectional view of the firearm safety device of FIGS. 1-7 taken along section line 8-8 of FIG. 3.
Figure 9:
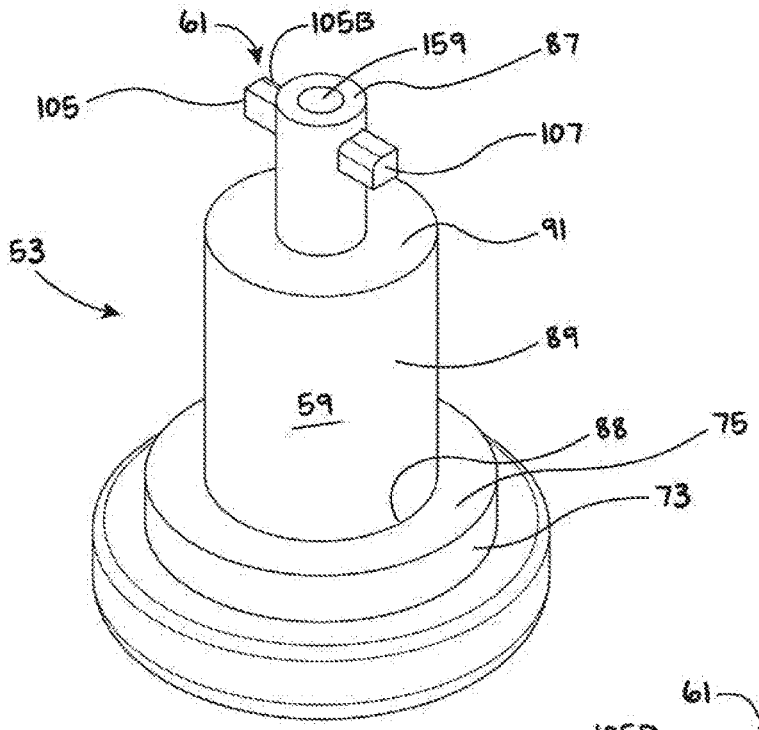
FIG. 9 is a perspective view of a first body portion of the firearm safety device of FIGS. 1-8, illustrating an example of a first catch.
Figure 10:
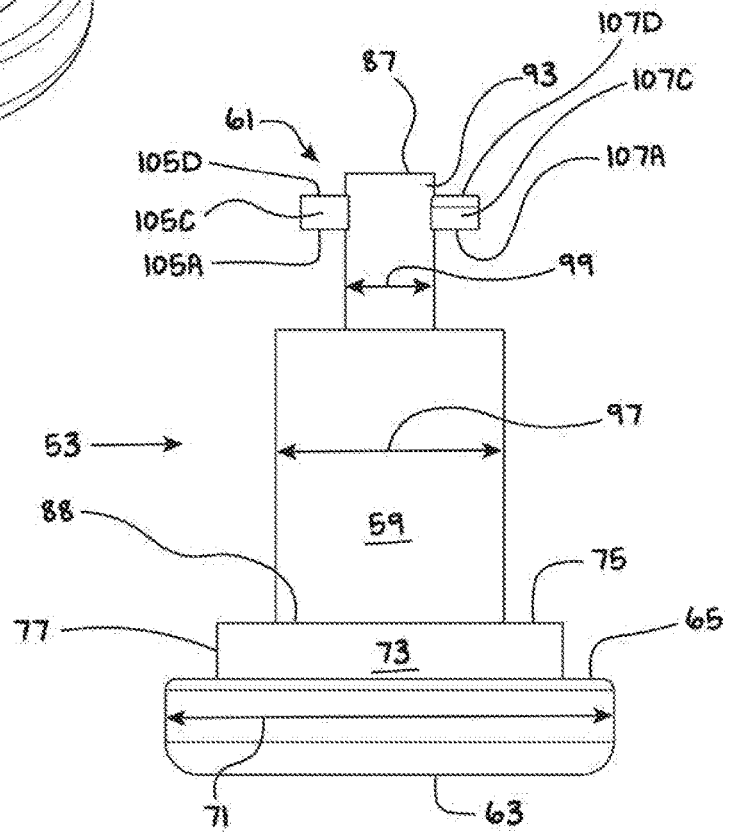
FIGS. 10-11 are side elevation views of the first body portion of FIG. 9.
Figure 11:
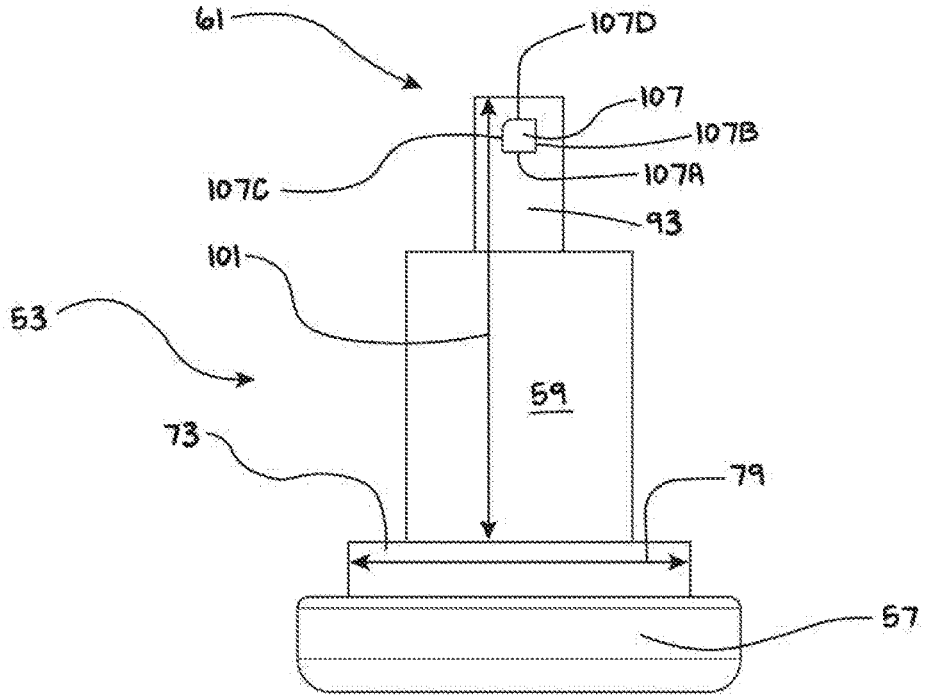
Figure 12:
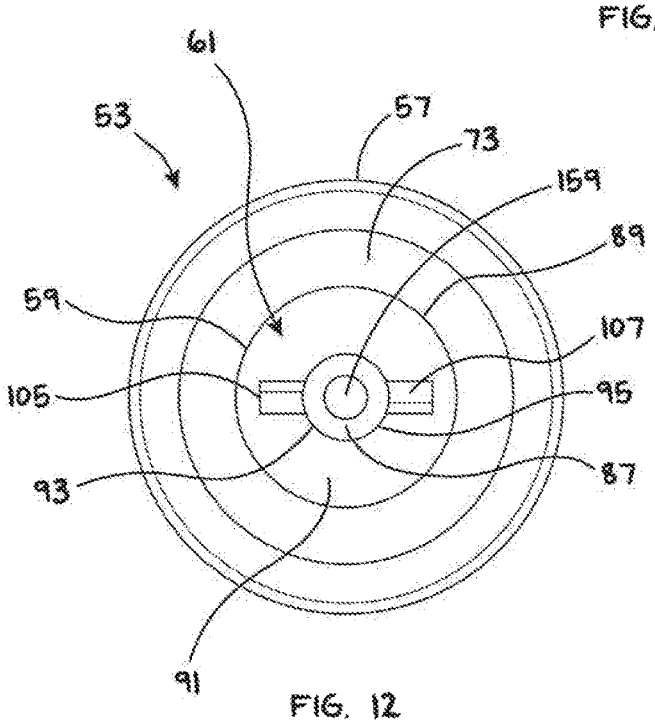
FIG. 12 is a rearward end view of the first body portion of FIG. 9.
Figure 13:
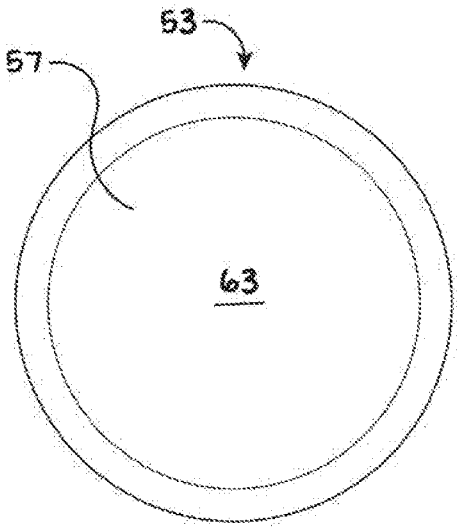
FIG. 13 is a forward end view of the first body portion of FIG. 9.
Figure 14:
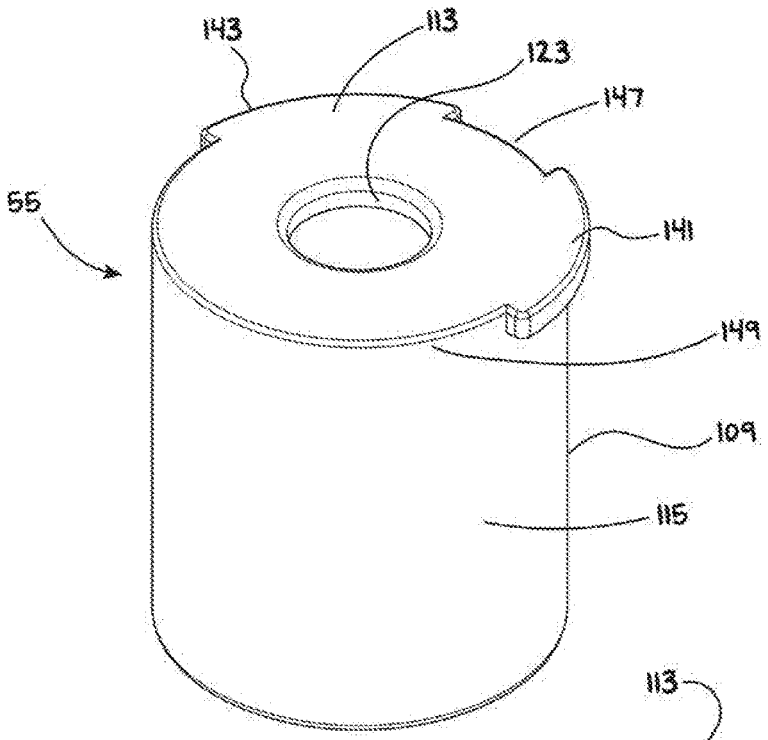
FIG. 14 is a perspective view of a second body portion of the firearm safety device of FIGS. 1-8.
Figure 15:
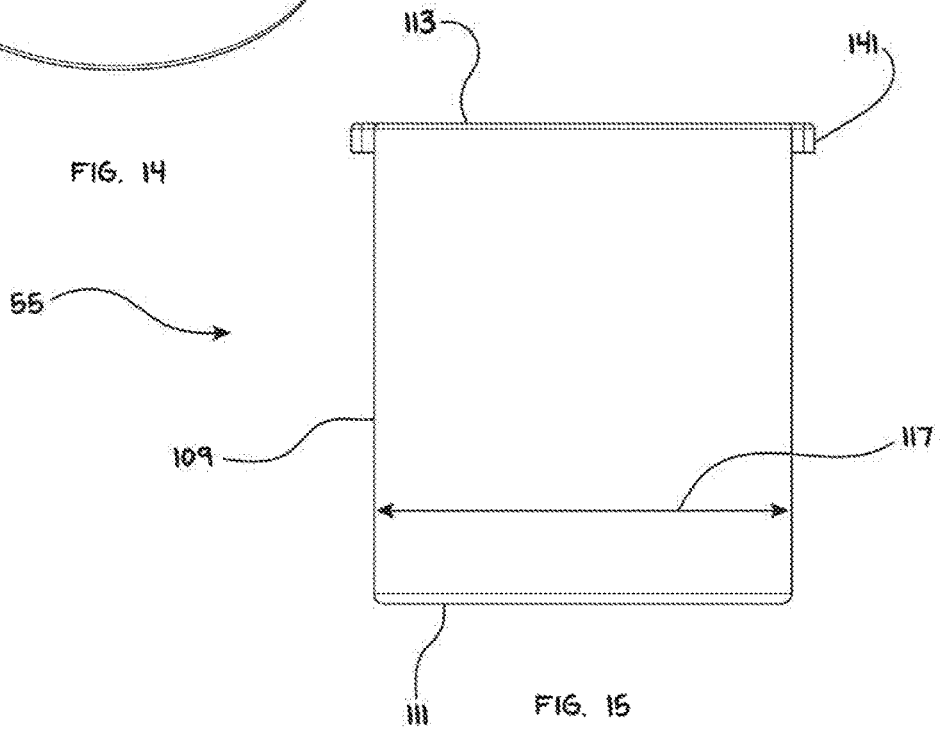
FIGS. 15-16 are side elevation views of the second body portion of FIG. 14.
Figure 16:
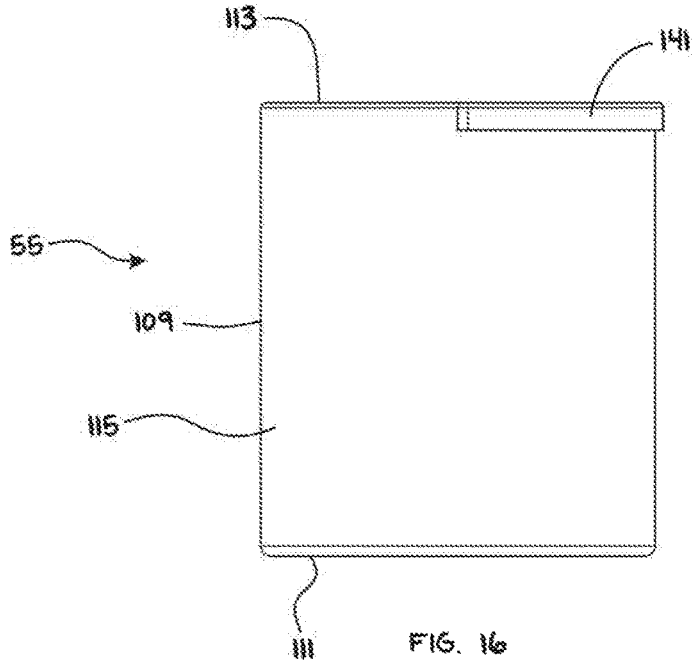
Figure 17:
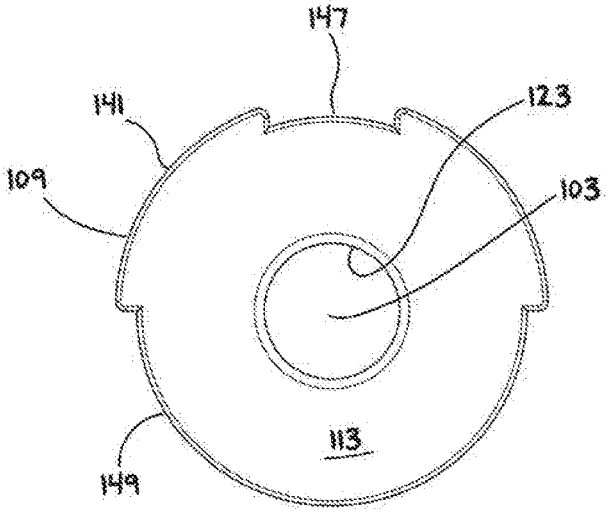
FIG. 17 is a rearward end view of the second body portion of FIG. 14.
Figure 18:
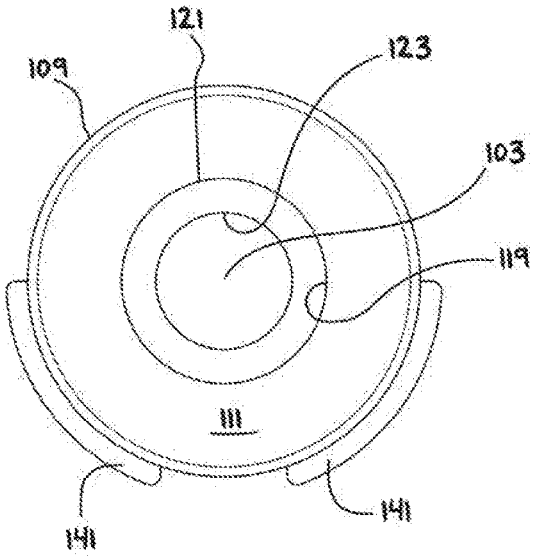
FIG. 18 is a forward end view of the second body portion of FIG. 14.

In the examples, contact member 151 may include body 153 with a striking surface 155 and a shaft 157 extending away from striking surface 155. Shaft 157 may be seated in mount 159 comprising an opening in distal end 87 of projection 93 portion of shaft 59 as illustrated in FIG. 8. Each of contact member body 153, shaft 157, and mount 159 may be coaxial with axis 67. Striking surface 155 of contact member 151 may be co-planar with plane 143 and rearward end 113 of casing 109. Contact member 151 may be permanently fixed to projection 93 of shaft 59 by means of an adhesive (not shown). Contact member 151 may be a one-piece part. Contact member 151 may be of a pliant, dampening-type material such as silicone or rubber.

Referring next to FIGS. 21-24C, key 13 component of firearm safety device 10 will next be described. In the embodiments, key 13 may have several different purposes. Key 13 may be utilized as an aid in positioning plug 11 within chamber 21. A further use of key 13 may be as an aid to rotate plug 11 within chamber 21 to align a notch 147, 149 of rim 141 with an extractor 47 of firearm 15 so that plug 11 cannot be ejected from chamber 21 by extractor 47 during operation of action 27. In the embodiments, an important function of key 23 is for use in pulling and removing plug 11 from chamber 21, and such pulling purpose provides important advantages and solves problems of the types described herein. As previously stated, key 13 may be considered a "puller key" because of the importance of key 13 for use in pulling plug 11 out of chamber 21 through the breech 23 end of chamber 21.

In the embodiments, key 13 may include a handle 161, a first end 163 and a second end 165. Each end 163, 165 may terminate in a second catch 167, 169, each of which is identical to the other in the examples. A first shank 171 may be between handle 161 and second catch 167 of first end 157, and a second shank 173 may be between handle 161 and second catch 167 of second end 165 of key 13. Each shank 171, 173 may be offset from handle 161 by approximately 90° as illustrated in FIGS. 21 and 24A-24C to assist the operator with insertion of second catch 167, 169 through an ejection port 51 and toward chamber 21.

First shank 171 may be implemented with a longer relative axial length than second shank 173. The different axial lengths of shanks 171, 173 may be implemented to enable a single key 13 to be used with different firearm 15 receivers 25 and to utilize a single key 13 with many different types of plugs 11 sized for use with firearms 15 of different types and calibers. Such a key 13 may be considered a type of "universal" key because of the utility of a single key 13 with different sizes and types of plugs 11. For example and as can be appreciated, a longer shank 171 may be needed for second catch 167 to be inserted through an ejection port 51 and to reach a chamber 21 of a semiautomatic rifle such as a Colt model M-4, whereas a relatively shorter shank 171 may be all that is required for second catch 167 to reach a chamber 21 of a break-action shotgun or a semi-automatic pistol. This feature of key 13 may be useful to owners of more than one type of firearm 15 who wish to utilize plural copies of safety device 10 with a single universal key 13. By way of example only, first shank 171 may have an axial length of about 1 inch and second shank 173 may have an axial length of 0.25 inch.

In the examples, each second catch 167, 169 may be identical to the other, In the examples, each second catch 167, 169 may be characterized as a type of tubular socket configured to engage with first catch 61 of plug 11. Each second catch 167, 169 may include a cylindrical tube 175, 177. Each tube 175, 177 may have an outside diameter 179 and circumference sized to fit through rearward end edge 123 and within keyway 103. Each tube 175, 177 inside diameter 181 is sized such that tube 175, 177 fits over projection 93 within keyway 103.

Figures 24A, 24B, 24C:
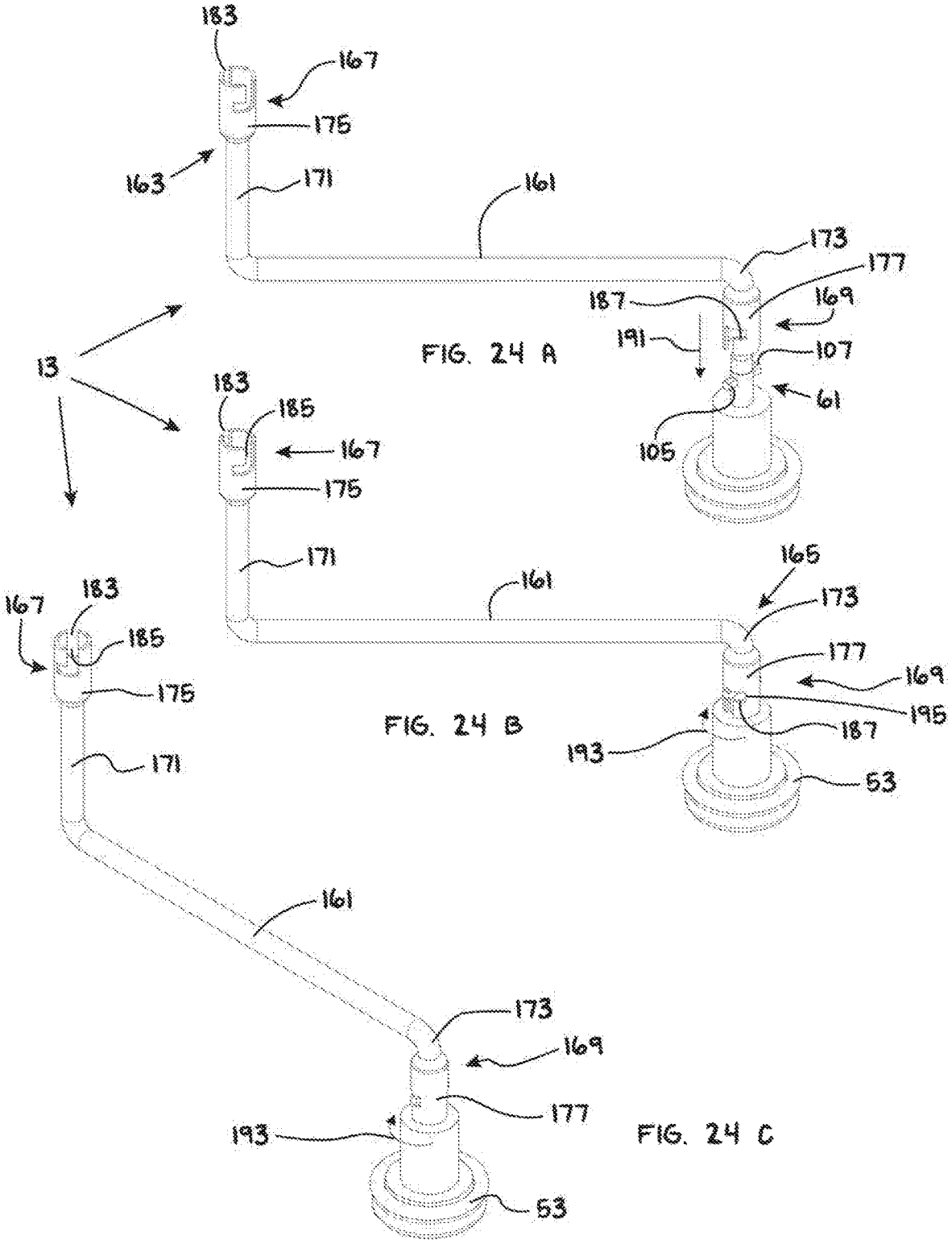
FIGS. 24A-24C are perspective views illustrating steps for engagement and disengagement of the first and second catches of FIGS. 14-17 and 21-23 respectively. with certain parts of the plug removed to facilitate understanding.

Referring further to FIGS. 211-24C, each tube 175, 177 may define a pair of arcuate slots 183, 185 extending in opposite directions on opposite sides of tube 175, 177 and resultant generally L-shaped curved surfaces 187, 189, When tube 175, 177 is fitted over projection 93 within keyway 103, generally L-shaped surfaces 187, 189 of a second catch 167, 169 are engageable with a respective pin 105, 107 of first catch 61 for purposes of pulling plug 11 out of breech 23 end of chamber 21 as described in the examples herein.

In the examples, slots 183, 185 defined by a respective tube 175, 177 are of a width sufficient to receive a pin 105 or 107 therein when a tube 175 or 177 is moved toward shaft 59 and projection 93 in the direction of arrow 191 (FIG. 24A). Rotation of tube 175 or 177 in the direction of arrow 193 (FIG. 24B) by swinging movement of handle 161 brings pin surfaces 105A, 107A facing away from rearward end 113 of casing 109 (and toward forward end 63) into opposed alignment with L-shaped surfaces 187, 189 facing away from forward end 63 of base 57 such that pulling of handle 161 in the direction opposite arrow 191 engages first catch 61 and a second catch 167 or 169 to apply a pulling force to displace plug 11 in the rearward direction indicated by arrow 205 (FIG. 25J).

Opposed axial end portions 195, 197 of L-shaped surfaces 187, 189 may be used to assist with rotation of plug 11 in chamber 21 to align a notch 147, 145 of rim 141 with an extractor 47 of action 27. Such rotation of plug 11 may be accomplished by rotation of tube 175 or 177 alternatively clockwise in the direction of arrow 193 or counter clockwise opposite arrow 193 such that end portion 195, 197 contacts and pushes a respective pin side surface 105C, 107D or 105B, 107C to apply a force which rotates plug 11 for alignment of a notch 147, 149 with extractor 47 or with plural extractors 47 to prevent ejection of plug 11 by extractors when action 27 is cycled.

Edge surfaces 199, 201 of a respective tube 175, 177 may be used to push against pin surfaces 105D, 107D facing toward rearward end 113 of casing 109 of plug 11 when key 13 is optionally used to insert plug 11 into chamber 21.

While a pair of generally L-shaped surfaces 187, 189 is shown with second catch 167 and 169, other structure may be implemented, such as a single L-shaped surface 187 or 189 with a corresponding change to first catch 61. Catch-type mechanisms other than the examples of first 61 catch and second catches 167, 169 may be implemented to engage a first catch of plug 11. Examples include detents, snaps, and threads.

Key 13 may be made of a broad range of materials, such as metals (e.g., high-grade steel) and polymeric materials.

An advantage of the plug 11 embodiments is that engagement of first and second catches 61 and 167 or 61 and 169 occurs within keyway 103 of plug 11 formed by first and second plug bodies 53, 55 and past rearward end 113 of casing 109 and second plug body 55 at a position shielded from contact with a human finger which limits unwanted removal of plug 11 from chamber 21, such as by tampering contact of plug 11 with a human finger.

Use of an example of firearm safety device 10 with a firearm 15 in the form of a pump-action shotgun, such as a Remington Model 870, will now be described in connection with FIGS. 24A-27. Firearm 15 in the form of the pump-action shotgun illustrated in FIGS. 25A-27 may be of a 12 gauge type with a smooth bore surface 202 inside barrel 39 typical of shotguns generally. It is to be understood that firearm safety device 10 may be adapted for use with virtually any type of firearm action, with any firearm caliber, gauge, or size, and with smooth bore and rifled barrels.

Figures 25A, 25B, 25C, 25D, 25E:
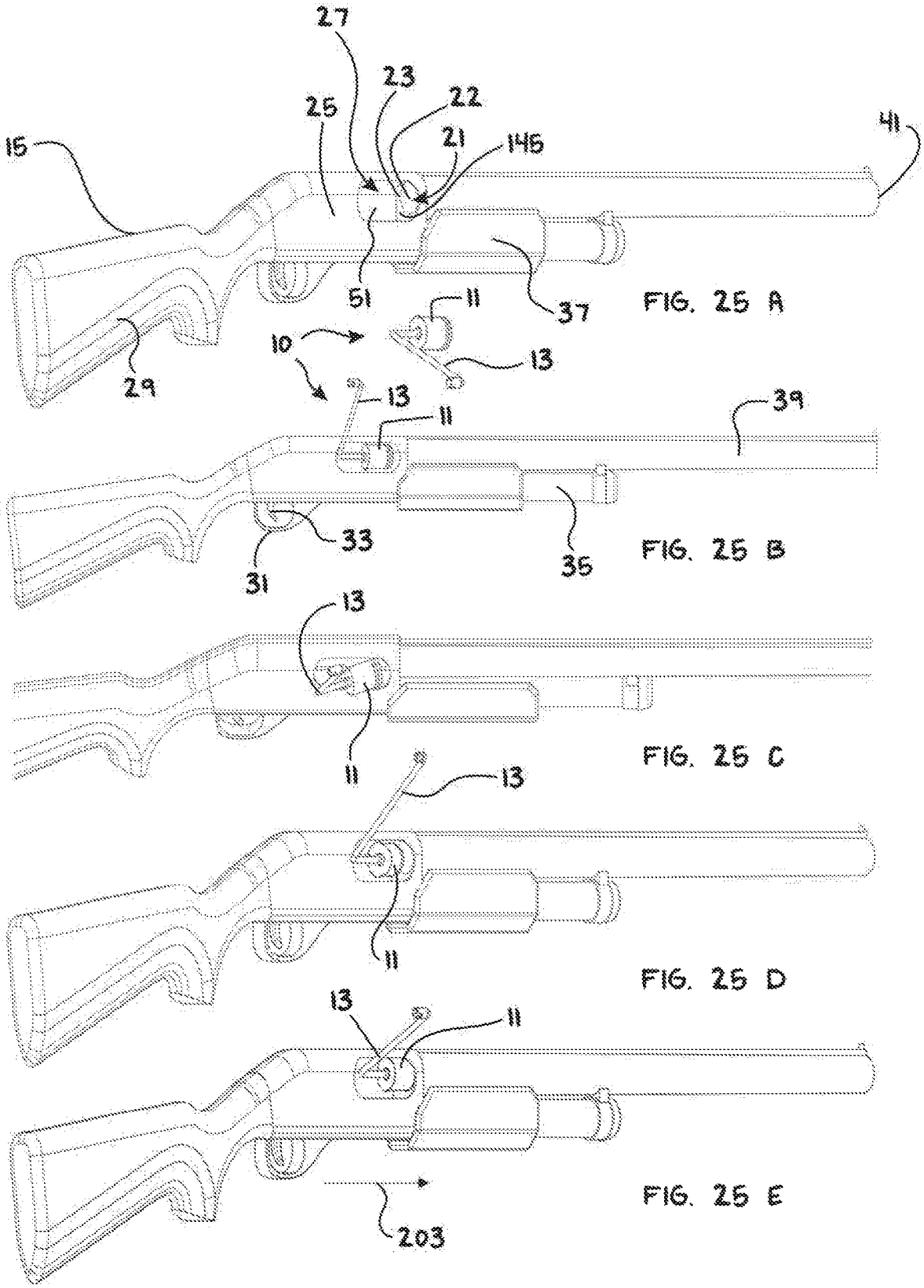
FIGS. 25A-25J are perspective views illustrating steps for insertion and removal of the firearm safety device of FIGS. 1-8 from a pump action shotgun-type firearm.
Figure 25F:
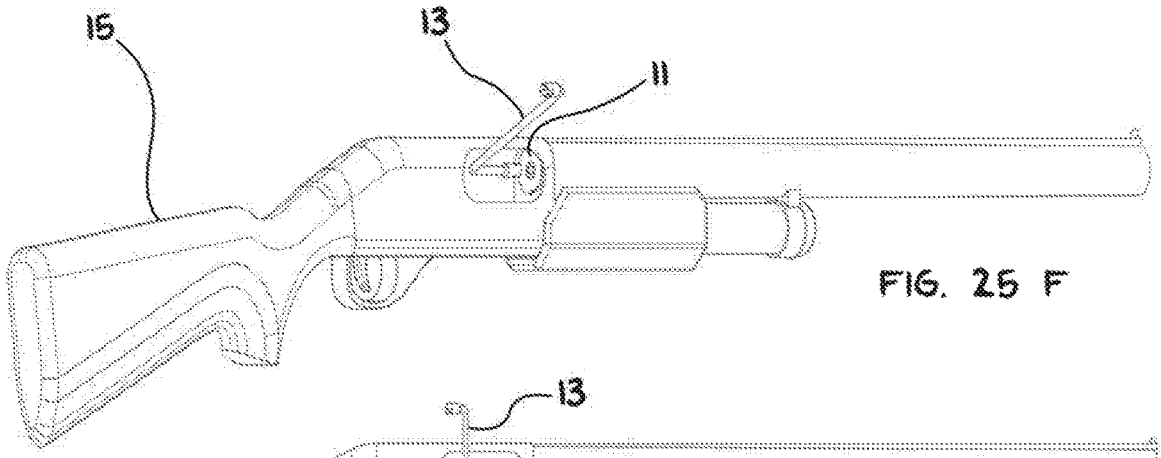
Figure 25G:
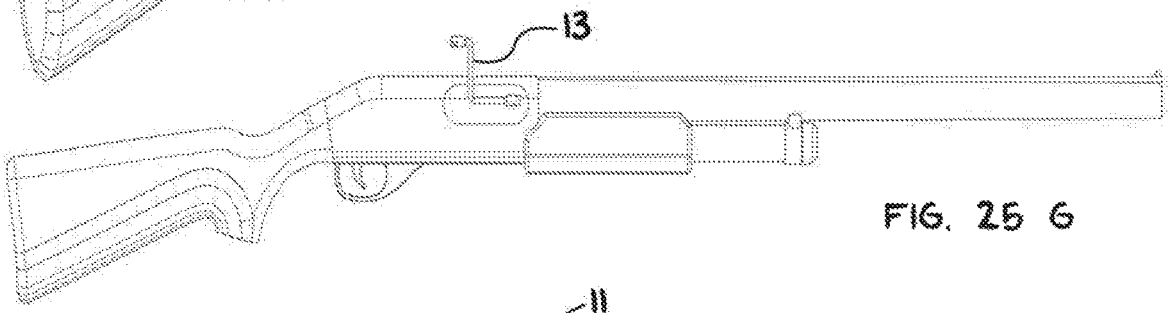
Figure 25H:
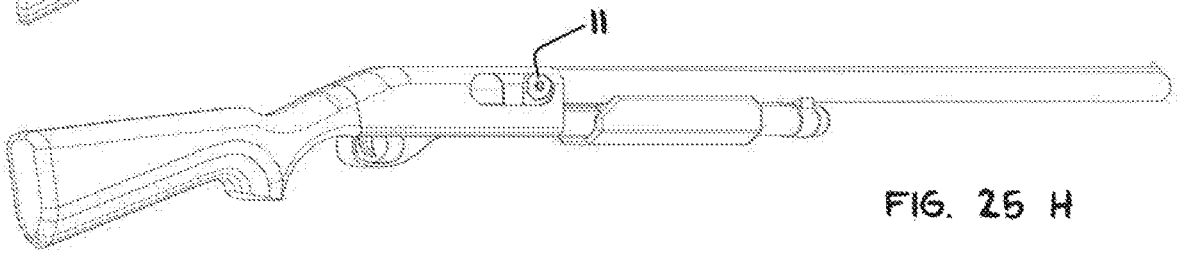
Figure 25I:
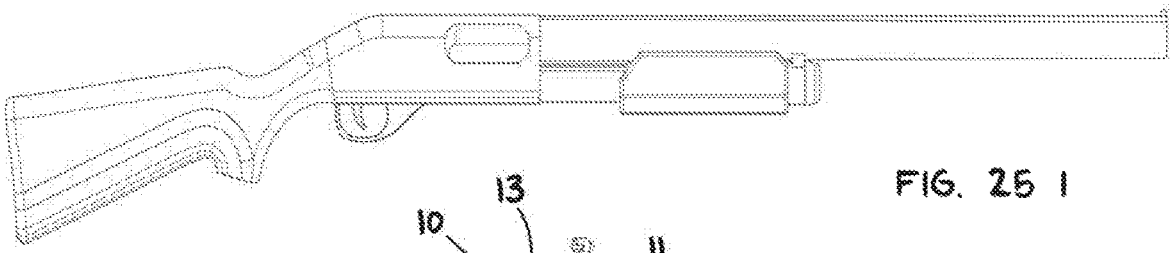
Figure 25J:
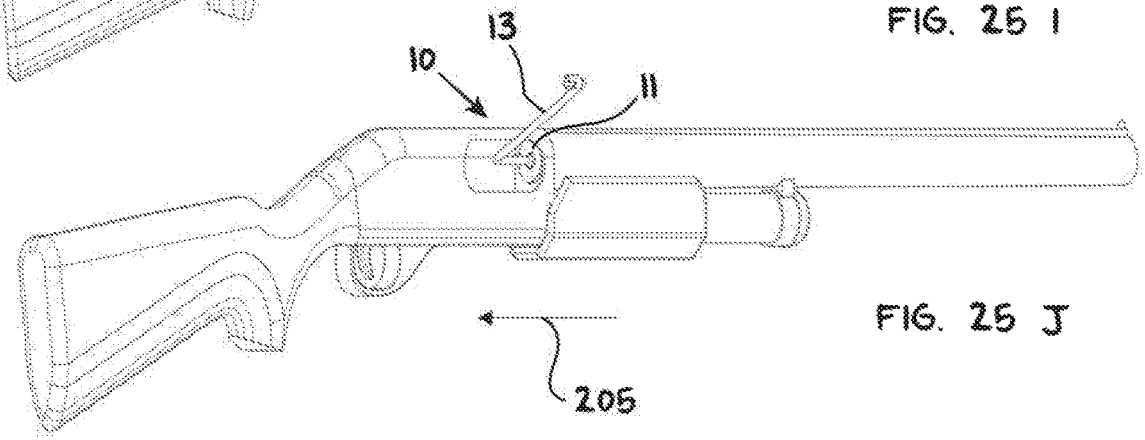

Referring then to FIG. 25A, fore-end 37 may be moved rearwardly to retract bolt 45 and open ejection port 51 providing access to breech 23 end of chamber 21. Firearm safety device 10 including a 12 gauge sized plug 11 and key 13 may be used to disable the pump-action shotgun of FIGS. 25A-25J.

As illustrated in FIGS. 24A-24C and FIG. 25A, key 13 first end 157 including the relatively longer shank 171 may be selected for use with pump action receiver 25 which has a relatively greater distance between ejector port 51 and chamber 21. Use of key 13 to insert plug 11 into chamber 21 is optional as a finger may be used to push plug 11 forward through breech 23 and into chamber 21 in the direction of muzzle 41 and arrow 203 (FIG. 25E).

Tube 175 of second catch 167 may be inserted into keyway 103 and over projection 93 with slots 183, 185 aligned with a respective pin 105, 107. Movement of tube 175 in the direction of arrow 191 (FIG. 24A) seats tube 175 on projection 93. With key 13 connected to plug 11, plug 11 may be moved adjacent to ejection port 51 as illustrated in FIG. 25B.

The sequence of FIGS. 25C-25E illustrate insertion of plug 11 through breech 23 of chamber 21. Key 13 with tube 175 seated on projection 93 is used as an optional positioning aid. As illustrated in FIG. 25C, forward end 63 of base 57 of first body portion 53 is initially inserted through ejection port 51 and into receiver 25. FIG. 25D illustrates that plug 11 is next aligned with barrel 39 and chamber 21 while within receiver 25. Forward end 63 of base 57 is next inserted into breech 23 end of chamber 21 in the forward direction indicated by arrow 191 as illustrated in FIG. 25E. Compressible member 85, in the form of an O-ring, extends past outer surfaces 69 and 115 of base 57 and casing 109. Compressible member 85 being pliant compresses as it slides along chamber wall 22 of chamber 21 as plug 11 moves deeper into chamber 21 in the forward direction of arrows 191 and 203.

In the example of FIG. 25, handle 161 of key 13 may be swung in the directions toward or away from arrow 193 (FIGS. 24B, 24C) to cause an axial end portion 195 of L-shaped surface 187, 189 to act against (i.e., push) a pin side surface 105C, 107D end portion 197 to push against a pin side 107C, 105D to rotate plug 11 within chamber 21 to align a notch 147, 149 of rim 141 with extractor 47 (FIGS. 26-27) so that extractor 47 will not eject plug 11 during cycling of action 27 and dry firing of firearm 15. Reverse rotation opposite arrow 193 then aligns slots 183, 185 with pins 105, 107 allowing tube 175 to be pulled away from projection 93 and plug 11 in the direction of arrow 205 (FIG. 25J), disengaging key 13 from plug 11 as illustrated in FIG. 25G.

FIGS. 25H-25I and 26-27 illustrate plug 11 inserted in chamber 21. Compressible member 85 is held in position within annular groove 83, or gap, by spacer 73 and exerts a force against chamber wall 22 to hold plug 11 in place within chamber 21. Rim 141 makes contact with outer wall 145 of receiver 25 to limit forward movement of plug 11 into chamber 21 in the direction of arrow 203 (FIG. 25E).

Firearm 15 is now disabled in the sense that plug 11 obstructs chamber 21 preventing a cartridge 17 in the form of a shotgun shell from being chambered. With a notch 147 or 149 aligned with extractor 47, firearm 15 action 27 may be repeatedly cycled and dry fired without ejection of plug 11 from firearm 15. The firing pin (not shown) may strike cushioned pliant surface of firing pin contact member 151 when trigger 33 is pulled by the operator. In this disabled state, firearm 15 may be safely used and the action 27 repeatedly cycled as would be desirable for many purposes such as demonstration of the firearm 15 to a potential purchaser in a retail sales and marketing setting, for training of military and law enforcement personnel, for firearm safety education for civilians, and for general safe storage purposes of the firearm 15.

Referring to FIGS. 24A-24C and 25J, when removal of plug 11 is desired the foregoing process is reversed. First catch 61 of plug 11 and second catch 167 or 169 of key 13 are engaged by insertion of tube 175 into ejection port 51 and receiver 25 and into keyway 103 of plug 11 over projection 93 with slots 183, 185 aligned with a respective pin 105, 107 as illustrated in FIG. 24A. Swinging movement of handle 161 of key 13 rotates tube 175 in the direction of arrow 193 aligns L-shaped surfaces 187, 189 with opposed pin surfaces 105A, 107A. Application of a pulling force by movement of key 13 in the direction of rearward arrow 205 (FIG. 25J) causes L-shaped surfaces 187, 189 to contact the respective pin surface 105A, 107A pulling plug 11 out through breech 23 end of chamber 21 in the direction of arrow 205 to remove the obstruction to chamber 21 provided by plug 11. With plug 11 removed, normal operation of the pump-action shotgun firearm 15 can occur.

In the embodiments, the elegant design of plug 11 is such that it obstructs chamber 21 for safe and repeated cycling of action 27 and dry firing of firearm 15 which may be aided by inclusion of firing pin contact member 151 to dissipate energy from striking movement of the firing pin. Tampering extraction of plug 11 is made difficult because rim 141 is closely against outer wall 145 of receiver 25 and is difficult to contact and pull. Tampering extraction of plug 11 with a finger is difficult because first catch 61 is within plug 11 accessible only to key 13. Consequently, just a minimal force, essentially just enough to counter gravity, is all that is required to hold plug 11 in chamber 21. This is a major advantage over devices which apply high force because plug 11 can be easily and quickly removed with a minimal pulling force applied by puller key 13 when operation of firearm 15 is desired. For example, a merchant using key 13 could quickly and easily remove plug 11 during a sales presentation of the firearm 15 to a customer. This, in turn, means less wear on compressible member 85 thereby extending plug 11 service life. Further, the lesser force applied against chamber wall 22 results in little or no opportunity for frictional damage to chamber 21 of firearm 15.

Long and unwieldy cleaning rods and tools for insertion down the barrel 39 are not required to remove or insert plug 11. This is again because key 13 pulls plug 11 from chamber 21, allowing for quick removal of plug 11 and avoiding damage to barrel 39 and the barrel 39 rifling which could be caused by the cleaning rod or tool. As mentioned, pulling removal of plug 11 through breech 23 end of chamber 21 minimizes travel of compressible member 85 and plug 11 along chamber 21 reducing wear and tear on compressible member 85, particularly when compared with devices that must be forcefully removed out through muzzle 41 end of barrel 39.

Plug 11 provides opportunities for simple and inexpensive manufacture. The novel assembly enables first catch 61 to be located within plug 11 in a manner that would be difficult to replicate using typical injection molding or machining techniques. The absence of moving parts from plug 11 further provides opportunities for cost reduction. Complex locking mechanisms are made unnecessary by the elegant plug 11 design.

The foregoing description is provided for the purpose of explanation and is not o be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. The disclosed firearm safety device 10 embodied by the examples of plug 11 and puller key 13 may address some or all of the problems previously described. A particular embodiment need not address all of the problems described, and the safety device 10 should not be limited to embodiments comprising solutions to all of these problems. Further, several advantages have been described that flow from the structure and methods; the present invention is not limited to structure and methods that encompass any or all of these advantages. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed is:

1. A firearm safety device for use with a firearm having a chamber, a barrel, and an action, comprising in combination:

a plug including:

a rigid body sized and shaped for insertion into the chamber through a breech end of the chamber out of removable contact with an extractor claw of the action, the body having fixed position forward and rearward ends, an axis between the ends, and an outer surface with a compressible member having an outside diameter greater than an inside diameter of the chamber to exert a force sufficient to snugly retain the body in the chamber against gravity;

a keyway extending axially into the body defined by a rearward end edge and an interior surface of the body, the rearward end edge defining a keyway opening shape and area sized such that the rearward end blocks insertion of a human finger into the keyway; and a first catch in fixed position within the keyway spaced in from the rearward end at a position within the body inaccessible to the finger; and a puller key including:

a handle having an end; and a second catch toward the end of the handle sized to fit through the keyway opening and into the keyway and interior of the body which engages the first catch within the keyway and the engagement of the catches enables pulling of the plug out of the breech end of the chamber, whereby, when in the chamber, the plug obstructs the chamber free of ejection by the extractor claw enabling repeated cycling of the action and dry firing of the firearm while preventing the chambering of a cartridge until pulled from the chamber with the puller key.

2. The firearm safety device of claim 1 wherein the force applied against the chamber wall by the compressible member of the body is about 7.5 ounce to about 11.5 ounce.

3. The firearm safety device of claim 1 wherein the body further includes an elongate axial shaft within the keyway coaxial with, or parallel to, the axis extending toward the keyway opening and having a distal end recessed behind the rearward end, and the first catch is associated with the shaft.

4. The firearm safety device of claim 3 wherein the first catch is at least one pin extending outward from the shaft within the keyway generally normal to the axis.

5. The firearm safety device of claim 4 wherein the at least one pin comprises a pair of pins each extending coaxially outward from the shaft within the keyway generally normal to the axis and the shaft has a T-shape.

6. The firearm safety device of claim 5 wherein the keyway opening defined by the rearward edge and interior is generally tubular.

7. The firearm safety device of claim 6 wherein the second catch comprises:

a tubular socket proximate the first end of the puller key handle, the socket being insertable through the keyway and over the shaft;

a pair of L-shaped curved surfaces extending in opposite directions around the socket engageable with a respective pin; and engagement of the pins with the L-shaped surfaces enables the pulling of the plug.

8. The firearm safety device of claim 7 wherein the handle includes an approximate right-angle bend enabling the first end of the handle and tubular socket to be inserted through an ejection port of the firearm and into contact with the pins.

9. The firearm safety device of claim 8 wherein the body has a generally-cylindrical shape and size corresponding to a generally-cylindrical shape of the chamber.

10. The firearm safety device of claim 9 wherein the compressible member further includes a frictional surface radially outward from the outer surface and the frictional surface snugly holds the body in the chamber.

11. The firearm safety device of claim 10 wherein the compressible member is an annular elastomeric member.

12. The firearm safety device of claim LI wherein the annular elastomeric member is an O-ring.

13. The firearm safety device of claim 12 wherein the body has an annular groove circumferentially around the body normal to the axis and an O-ring is seated in the annular groove.

14. The firearm safety device of claim 13 wherein the body further has a rim extending radially outward from the rearward end of the body in a plane normal to the axis and defining at least one radially-outward notch providing contact avoidance between the rim and the extractor claw.

15. The firearm safety device of claim 14 wherein the body further has a firing pin contact member coaxial with the axis toward the rearward end of the body.

16. The firearm safety device of claim 15 wherein the firing pin contact member is seated on the distal end of the shaft and is of a pliant material.

17. A plug-type firearm safety device for obstructing a firearm chamber to prevent chambering of a cartridge therein while allowing repeated cycling and dry firing of the firearm, comprising:

a first rigid body portion including:

a cylindrically-shaped forward portion defining an axis and having forward and rearward end surfaces with an outer surface therebetween coaxial with the axis and having an outside diameter sized for insertion into the chamber through a breech end of the chamber; and an elongate shaft extending out and away from the rearward end surface to a shaft distal end, the shaft further having a first catch associated therewith;

a second rigid body portion connected in fixed position to the first body portion, including:

a cylindrically-shaped rearward portion having forward and rearward ends with an outer surface therebetween coaxial with the axis and having an outside diameter approximately the same as the outside diameter of the first body portion;

a shaft-receiving space and keyway defined by an inner wall and forward and rearward end edges of the rearward portion, the shaft being inserted through the forward end edge and located within the space with the first catch within the keyway spaced in from the rearward end of the rearward portion at a position inaccessible to a finger yet accessible to a second catch of a puller key insertable into the keyway and into pulling engagement with the first catch; and a rim extending radially outward from the rearward end of the rearward portion in a plane normal to the axis and defining at least one radially-outward notch providing contact avoidance between the rim and an extractor claw of the firearm enabling the repeated cycling and dry firing of the firearm without ejection of the safety device;

a spacer between the first and second body portions spaced in from the outer surfaces defining an annular groove between the first and second body portions; and a compressible member around the annular groove having an outside diameter greater than an inside diameter of the chamber to exert a force sufficient to snugly retain the safety device in the chamber against gravity.

18. The firearm safety device of claim 17 wherein the force applied against the chamber wall by the compressible member is about 7.5 ounce to about 11.5 ounce.

19. The firearm safety device of claim 17 wherein the first catch is at least one pin extending outward from the shaft within the keyway generally normal to the axis.

20. The firearm safety device of claim 19 wherein the at least one pin comprises a pair of pins each extending coaxially outward from the shaft within the keyway generally normal to the axis and the shaft has a T-shape.

21. The firearm safety device of claim 19 wherein the spacer is integral with the rearward end surface of the first body portion and the shaft.

22. The firearm safety device of claim 19 wherein the compressible member is an annular elastomeric member.

23. The firearm safety device of claim 22 wherein the annular elastomeric member is an O-ring.

24. The firearm safety device of claim 23 further including a firing pin contact member seated on the distal end of the shaft having a striking surface co-planar with the rearward end surface of the second body portion.

25. The firearm safety device of claim 24 wherein the puller key includes:

a handle having a first end sized to fit through the keyway opening; and the second catch proximate the first end of the handle.

26. The firearm safety device of claim 25 wherein the second catch comprises:

a tubular socket proximate the first end of the handle, the socket being insertable through the keyway and over the shaft;

a pair of L-shaped curved surfaces extending in opposite directions around the socket engageable with a respective pin; and engagement of the pins with the L-shaped surfaces enables the puffing of the plug.

27. The firearm safety device of claim 26 wherein the handle includes an approximate right-angle bend enabling the first end of the handle and tubular socket to be inserted through an ejection port of the firearm and into contact with the pins.

28. The firearm safety device of claim 27 wherein the puller key is a single universal puller key sized to engage and pull a plurality of the safety devices according to claim 17, each safety device having a different outer diameter sized to fit a respective chamber of a different size.

* * * * *